US010920530B2

(12) United States Patent
Cho et al.

(10) Patent No.: US 10,920,530 B2
(45) Date of Patent: Feb. 16, 2021

(54) SYSTEM AND METHOD FOR COMPLETING AND STIMULATING A RESERVOIR

(71) Applicant: Schlumberger Technology Corporation, Sugar Land, TX (US)

(72) Inventors: Brian W. Cho, Katy, TX (US); Jose F. Garcia, Sugar Land, TX (US); Roberto Simao Trad, Pearland, TX (US); John Algeroy, Houston, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 605 days.

(21) Appl. No.: 15/143,400

(22) Filed: Apr. 29, 2016

(65) Prior Publication Data

US 2017/0037706 A1 Feb. 9, 2017

Related U.S. Application Data

(60) Provisional application No. 62/154,591, filed on Apr. 29, 2015.

(51) Int. Cl.

| | |
|---|---|
| ***E21B 34/12*** | (2006.01) |
| ***E21B 43/26*** | (2006.01) |
| ***E21B 34/14*** | (2006.01) |

(52) U.S. Cl.
CPC ..... *E21B 34/12* (2013.01); *E21B 34/14* (2013.01); *E21B 43/26* (2013.01); *E21B 2200/06* (2020.05)

(58) Field of Classification Search
None
See application file for complete search history.

(56) References Cited

U.S. PATENT DOCUMENTS

| | | | | |
|---|---|---|---|---|
| 4,770,243 | A * | 9/1988 | Fouillout | E21B 47/113 166/53 |
| 8,857,516 | B2 | 10/2014 | Ganguly et al. | |
| 10,041,331 | B2 * | 8/2018 | Ross | E21B 34/14 |
| 2006/0144590 | A1 | 7/2006 | Lopez de Cardenas et al. | |
| 2009/0283279 | A1 | 11/2009 | Patel et al. | |

* cited by examiner

*Primary Examiner* — Matthew R Buck
*Assistant Examiner* — Douglas S Wood
(74) *Attorney, Agent, or Firm* — Kelly McKinney

(57) ABSTRACT

A technique facilitates completion and stimulation of a reservoir, e.g. a lower tertiary reservoir. Initially a wellbore is drilled into the tertiary reservoir. Following drilling, the wellbore is completed by deploying completion equipment constructed to facilitate stimulation of the tertiary reservoir. The completion equipment may be operated in conjunction with a stimulation system to stimulate the tertiary reservoir and thus to enhance retrieval of hydrocarbon fluids contained within the tertiary reservoir.

10 Claims, 35 Drawing Sheets

SYSTEM AND METHOD FOR COMPLETING AND STIMULATING A RESERVOIR

CROSS REFERENCE TO RELATED APPLICATIONS

This application claims the benefit of, and priority to, U.S. Patent Application Ser. No. 62/154,591, filed Apr. 29, 2015, which is incorporated herein by this reference in its entirety.

BACKGROUND

The production of hydrocarbons fluids involves the drilling of wellbores into hydrocarbon bearing formations. In various applications, a lateral wellbore or a plurality of lateral wellbores may be drilled into a tertiary reservoir to facilitate retrieval of the desired hydrocarbon fluids. Once a lateral wellbore is drilled, completions may be deployed downhole into the wellbore. Additionally, stimulation processes may be employed to stimulate the reservoir and to enhance release and retrieval of the hydrocarbon fluids.

SUMMARY

In general, a system and methodology are provided to facilitate completion and stimulation of a reservoir, e.g. a lower tertiary reservoir. Following drilling of a wellbore into the reservoir, e.g. the tertiary reservoir, the wellbore is completed by deploying completion equipment constructed to facilitate stimulation of the reservoir. The completion equipment may be operated in conjunction with a stimulation system to stimulate the reservoir and thus to enhance retrieval of hydrocarbon fluids contained within the reservoir.

However, many modifications are possible without materially departing from the teachings of this disclosure. Accordingly, such modifications are intended to be included within the scope of this disclosure as defined in the claims.

BRIEF DESCRIPTION OF THE DRAWINGS

Certain embodiments of the disclosure will hereafter be described with reference to the accompanying drawings, wherein like reference numerals denote like elements. It should be understood, however, that the accompanying figures illustrate the various implementations described herein and are not meant to limit the scope of various technologies described herein, and.

DETAILED DESCRIPTION

In the following description, numerous details are set forth to provide an understanding of some embodiments of the present disclosure. However, it will be understood by those of ordinary skill in the art that the system and/or methodology may be practiced without these details and that numerous variations or modifications from the described embodiments may be possible.

The present disclosure generally relates to a system and methodology to facilitate completion and stimulation of a reservoir, such as a lower tertiary reservoir. Initially, a wellbore drilling operation is performed which may comprise the drilling of at least one vertical and/or deviated, e.g. horizontal, wellbore. Following drilling, the wellbore is completed by deploying completion equipment constructed to facilitate stimulation of the reservoir. The completion equipment may be operated in conjunction with a stimulation system to stimulate the reservoir and thus to enhance retrieval of hydrocarbon fluids contained within the reservoir. In a variety of applications, the completion and stimulation system is very suitable for use as a tight reservoir stimulation platform.

According to an embodiment, a zonal fracture and flow system may comprise a variety of cooperating assemblies. For example, the overall system may comprise a zonal frac and flow valve assembly having a frac sleeve valve with an integrated flow control valve for zonal flow control. The overall system also may comprise a frac tip assembly which may be at the tip of a stimulation string and enables conversion from a forward circulating fracture mode to a reverse circulating mode. Another assembly may comprise a frac locating assembly which locates and controls the tip of the stimulation string. A resettable shifting assembly also may be employed as part of the overall system to control opening and closing of the frac sleeve. The various assemblies may be employed in a zonal fracture and flow workflow sequence to facilitate the well stimulation and production.

Figure 1:
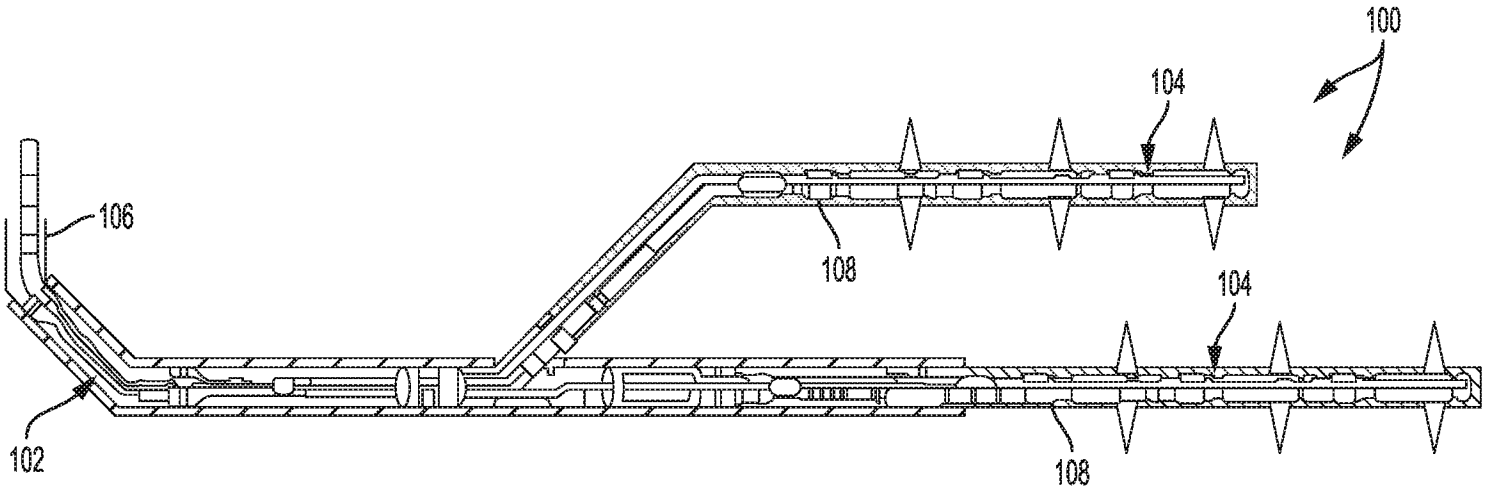
FIG. 1 is a schematic illustration of an example of a well system deployed in a wellbore, according to an embodiment of the disclosure.

Referring initially to FIG. 1, an example of a well system 100 is illustrated as comprising a multilateral zonal contact and flow control system 102 deployed in a well. The overall system 102 may comprise a plurality of zonal fracture and flow systems 104. By way of example, the well may comprise at least one vertical wellbore 106 connected with at least one lateral wellbore 108. As illustrated, the zonal fracture and flow system 102 may comprise a variety of components and assemblies, such as the feed through Y-block assemblies, the feed through seal assemblies, the zonal flow control valves, and the feed through seal assemblies. Various assemblies of the zonal contact and flow control system 102 are explained in greater detail below. However, a variety of other and/or additional components and assemblies may be incorporated into the overall zonal contact and flow system 102 depending on the parameters of a given application.

In general, each zonal fracture and flow system 104 may be constructed to enable isolation of the well casing from frac pressure via, for example, frac seals located downhole. The system 104 also may isolate the formation after frac stimulation by, for example, closing off the inside diameter. Additionally, the system may be operated in a reverse stage without exerting pressure on the formation by, for example, closing off an inside diameter and opening a reverse port. The system also enables control over the position of a frac tip throughout a frac job by locating and controlling the tip of the fracturing string. The system also does not over displace the formation, thus leaving more proppant in the fractures. In some applications, the system 104 includes at least one resettable mechanical shifting assembly to shift a zonal contact valve. However, the system 104 does not allow unwanted sand slurry to flow across the shifting assembly. In some examples, a fracture sleeve may open in an up position and close in a down position. In various applications, the stimulation may occur one valve at a time with one valve per well zone. The stimulation may be started from the bottom valve and moved upwardly. In some applications, a screen position may be eliminated and an electric flow control and zonal contact valve may be combined, as described in greater detail below.

Figure 2:
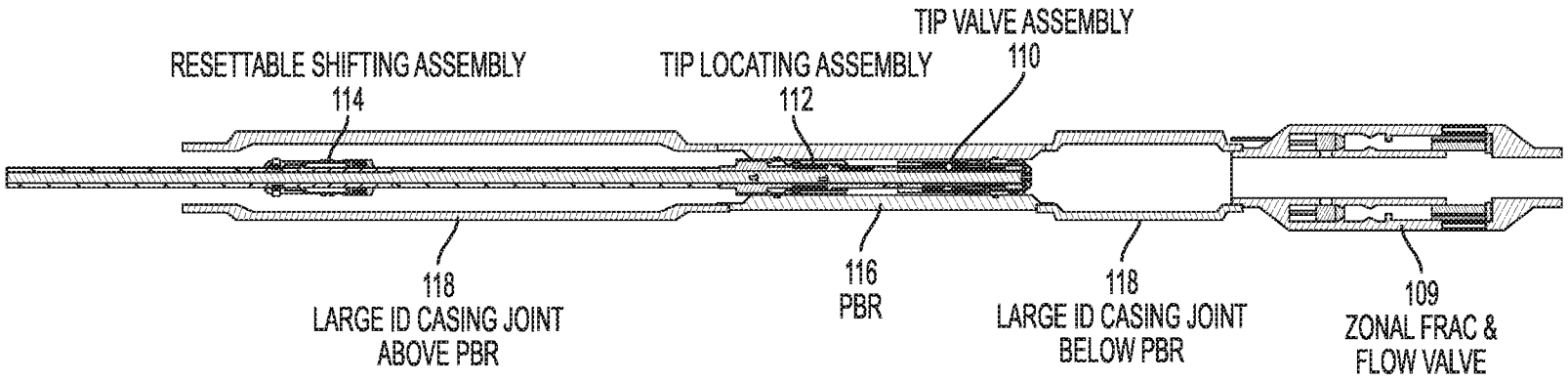
FIG. 2 is a schematic illustration of an example of a zonal fracturing and flow stimulation system, according to an embodiment of the disclosure.

By way of example, the zonal fracturing and flow system architecture may be constructed to efficiently frac pack tight reservoir formations, e.g. a lower tertiary formation. Each system 104 provides a large flowing inside diameter to maximize the frac pump pressure and the pump rates through the frac stimulation string. The zonal concept of the system architecture uses zonal flow control through compartmentalization of the reservoir and independently controls the flow from each zonal fracture and flow system 104. Referring generally to FIG. 2, a schematic of an example of a zonal fracturing and flow stimulation system is shown, according to an embodiment of the disclosure. The well schematic illustrates a sequence of tools that may be repeated for each separate reservoir to facilitate the fracturing and flow. By way of example, each zonal fracture and flow system 104 may comprise a zonal frac and flow valve assembly 109, a tip valve assembly 110, a tip locating assembly 112, and a resettable shifting assembly 114 as illustrated. In FIG. 2, the tip valve assembly 110 and the tip locating assembly 112 are disposed in a polished bore receptacle (PBR) 116. A large inside diameter casing joint 118 is located below the PBR 116 and between the PBR and zonal frac and flow valve assembly 109. Additionally, the resettable shifting assembly 114 may be located within a large inside diameter casing joint positioned above the PBR.

Figure 3:
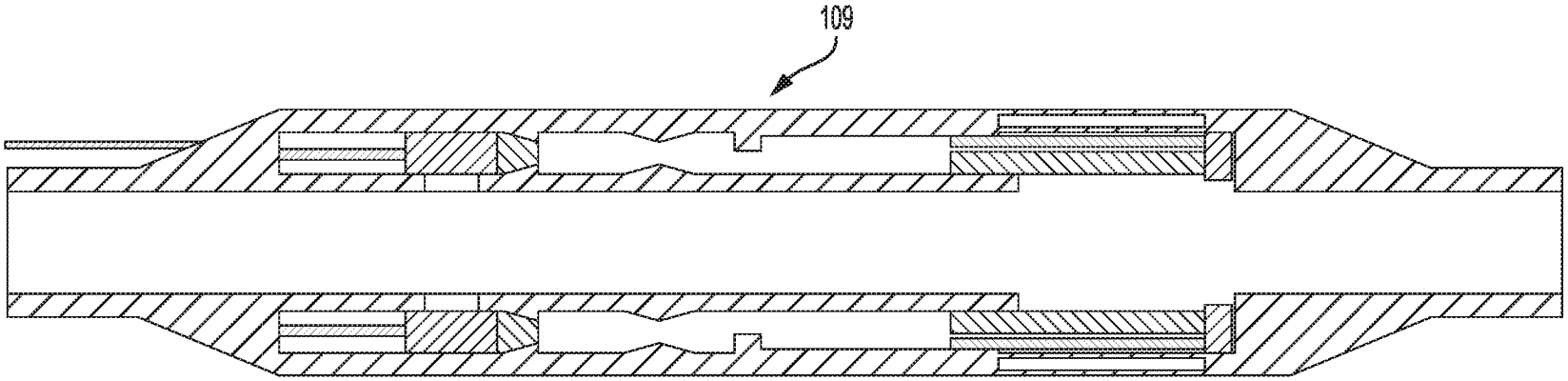
FIG. 3 is a schematic illustration of an example of a zonal fracturing and flow valve assembly, according to an embodiment of the disclosure.
Figure 4:
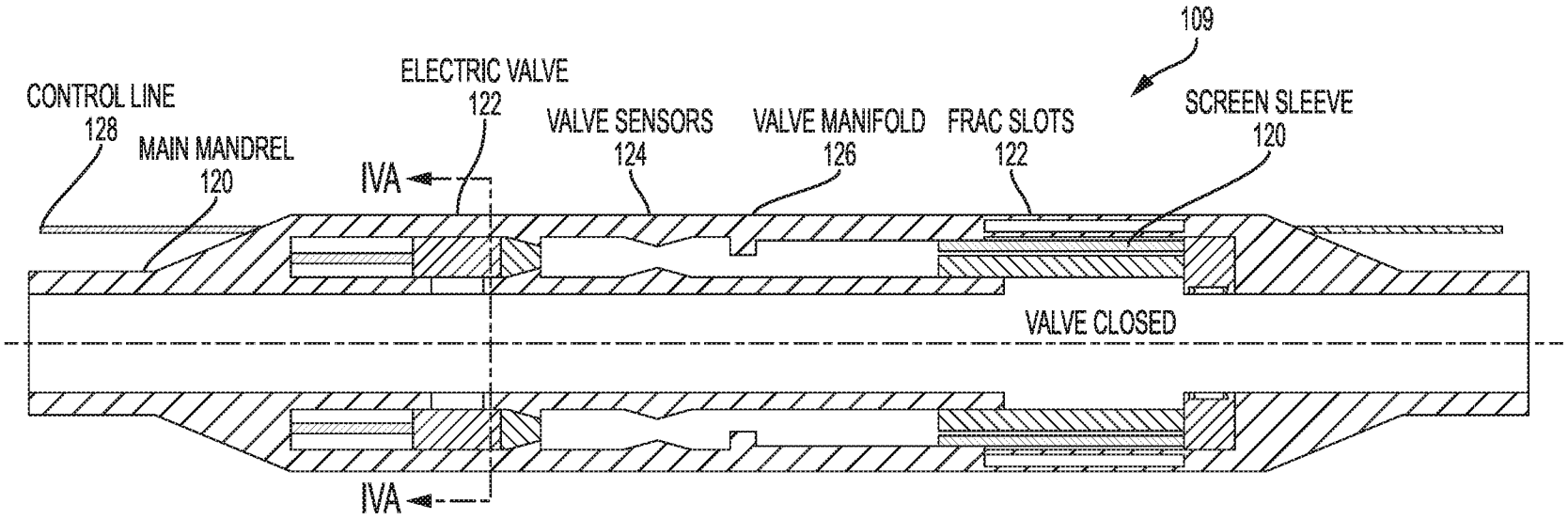
FIG. 4 is a schematic illustration of another example of a zonal fracturing and flow valve assembly, according to an embodiment of the disclosure.
Figure 4A:
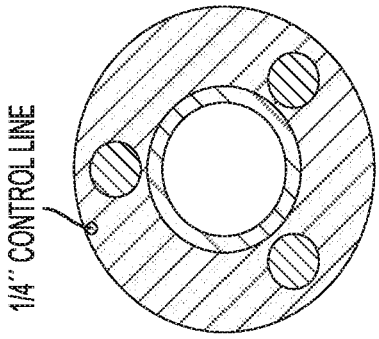
FIG. 4A is a cross-sectional view taken along IVA.
Figure 5:
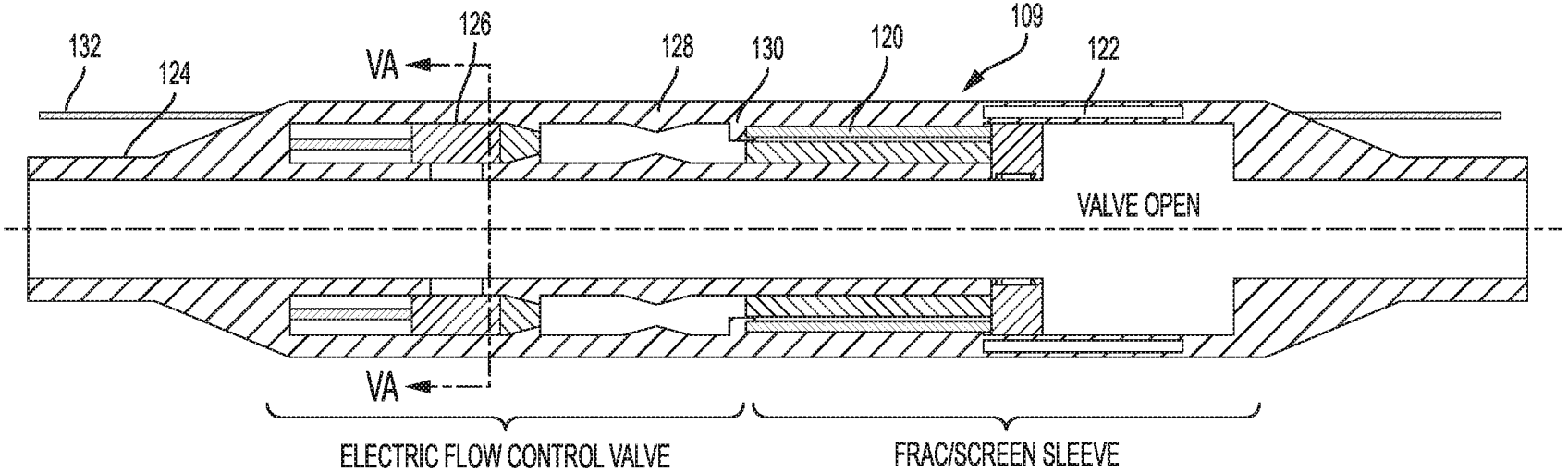
FIG. 5 is a schematic illustration of the zonal fracturing and flow valve assembly illustrated in FIG. 4 but in a different operational position, according to an embodiment of the disclosure.
Figure 5A:
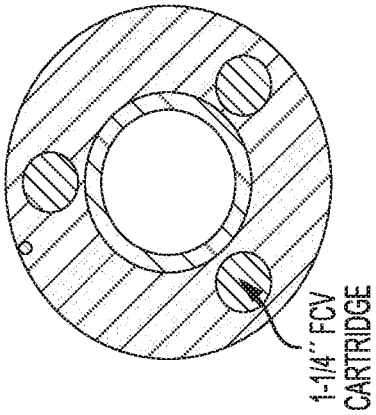
FIG. 5A is a cross-sectional view taken along VA.
Figure 7A:
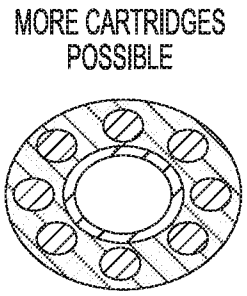
FIG. 7A is a cross-sectional view taken along VIIA.

Referring initially to the zonal frac and flow valve assembly 109 (see also FIG. 3), this assembly may comprise an enhanced zonal control valve cemented in the well similar to a liner assembly. A wash pipe cementing system may be employed to avoid contaminating the inside diameter of the zonal frac and flow valve assembly. The unique valve assembly may be used for frac stimulation and also immediately used as a zonal flow control valve. This use may be accomplished by integrating a screen assembly 120 and a closing sleeve assembly from a zonal contact valve. Effectively, the new screen/sliding sleeve becomes a sleeve that controls the opening and closing of the frac slots 122, as illustrated in FIGS. 4 and 5. When the screen/sliding sleeve is in the opened position (see FIG. 5), the zonal frac and flow valve assembly becomes a zonal contact valve. However, the valve assembly may be readily shifted to the closed position, as illustrated in FIG. 4. It should be noted that the zonal frac and flow valve assembly 109 may comprise a variety of other components, including a main mandrel 124, an electric valve 126, valve sensors 128, a valve manifold 130, and a control line 132.

Figure 6A:
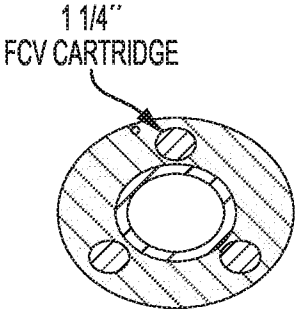
FIG. 6A is a cross-sectional view taken along VIA.
Figure 6:
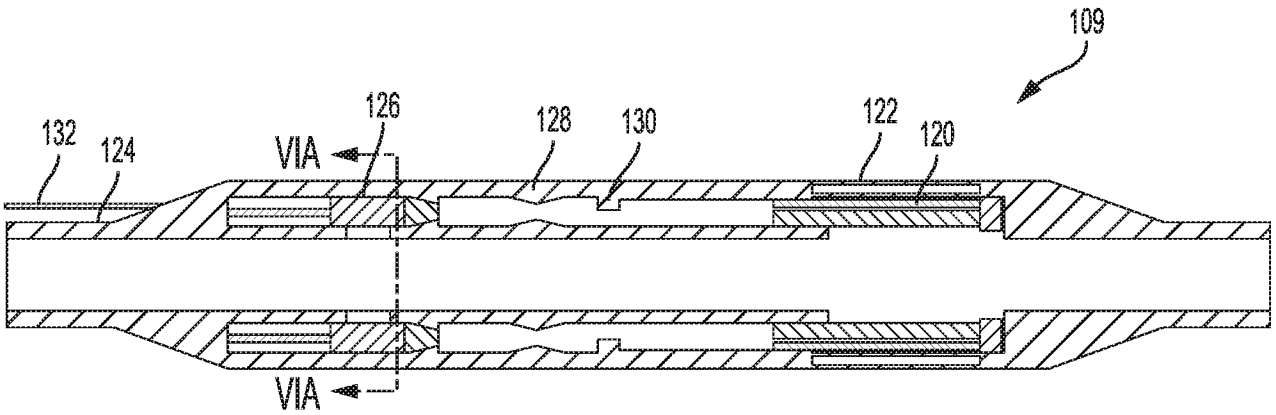
FIG. 6 is a schematic illustration of a zonal fracturing and flow valve assembly in an initial stage of operation, according to an embodiment of the disclosure.
Figure 7:
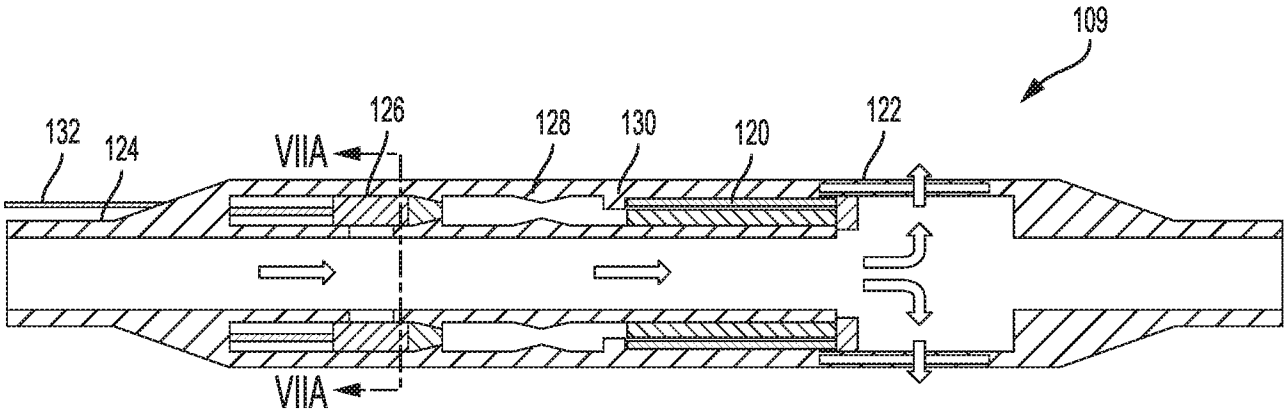
FIG. 7 is a schematic illustration of the zonal fracturing and flow valve assembly in a subsequent stage of operation, according to an embodiment of the disclosure.
Figure 8A:
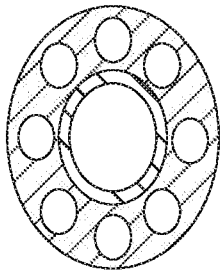
FIG. 8A is a cross-sectional view taken along VIIIA.
Figure 8:
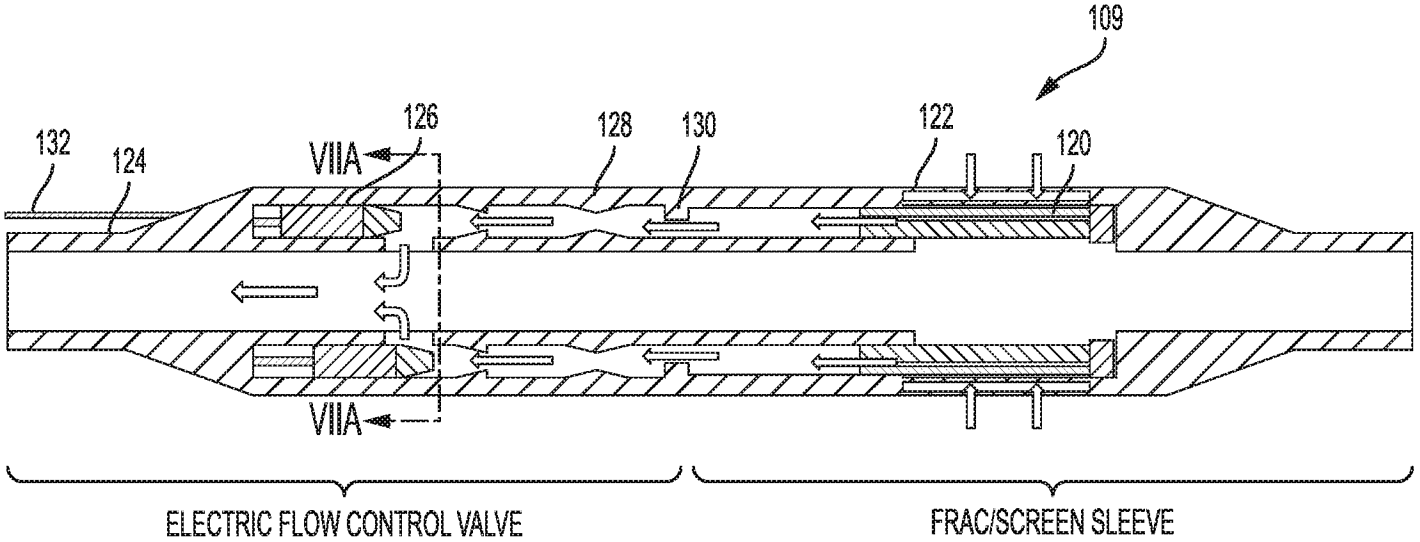
FIG. 8 is a schematic illustration of the zonal fracturing and flow valve assembly in a subsequent stage of operation, according to an embodiment of the disclosure.

An operational example of the use of zonal frac and flow valve assembly 109 is illustrated in FIGS. 6-8. In this example, the screen/sliding sleeve 120 is in a closed position when run into the wellbore, as illustrated in FIG. 6. The screen/sliding sleeve 120 is subsequently opened for frac stimulation as fracturing fluid (shown as arrows) flows outwardly through the frac ports 122, as illustrated in FIG. 7. Thereafter, the screen/sliding sleeve 120 may again be closed to enable a production flow of fluid (shown as arrows), as illustrated in FIG. 8.

Figure 9:
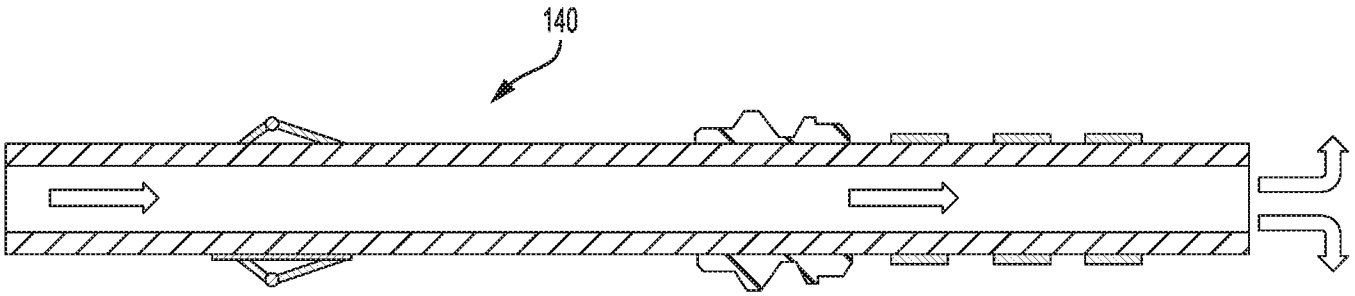
FIG. 9 is a schematic illustration of a portion of a well string in an operational configuration, according to an embodiment of the disclosure.
Figure 10:
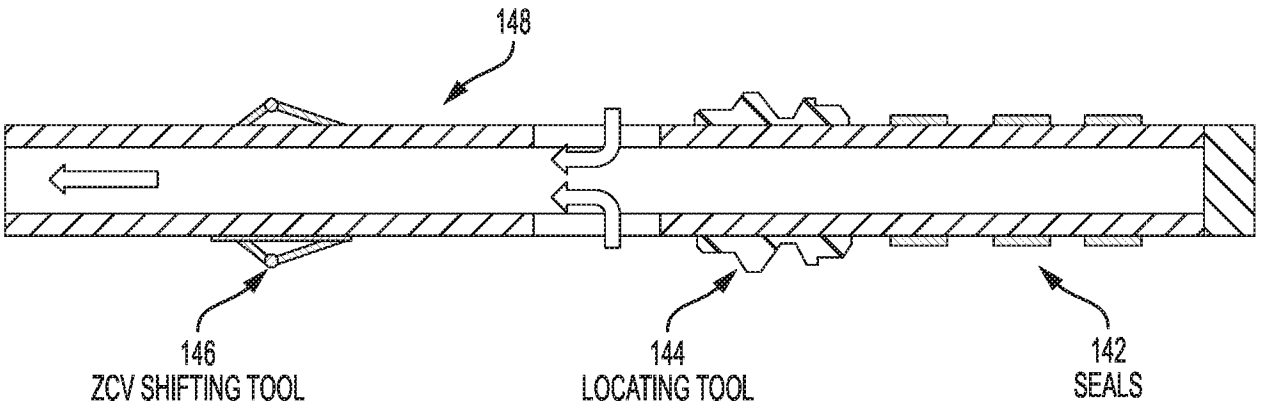
FIG. 10 is a schematic illustration similar to that of FIG. 9 but in a different operational configuration, according to an embodiment of the disclosure.

Referring generally to FIGS. 9 and 10, a schematic illustration is provided of a frac stimulation string 140 including seals 142, a locating tool 144, and a zonal control valve shifting tool 146. In this example, an unimpeded or substantially unimpeded inside diameter is used to maximize unimpeded flow and thus to maximize fracturing efficiency, as illustrated in the full ID fracture configuration of FIG. 9. The system also ensures the process does not close the fractures and does not over displace so as to leave proppant in the fractures. Once the job is completed, the left over proppant within the tubing is reversed out without exerting pressure on the just stimulated reservoir, as illustrated via the isolated ID reverse configuration of FIG. 10. In FIG. 10, the zonal control valve shifting tool 146 has opened a valve 148. It should be noted the frac stimulation string also may be shifted to a closed ID isolation configuration in which the ID is closed off the flow.

Figure 11:
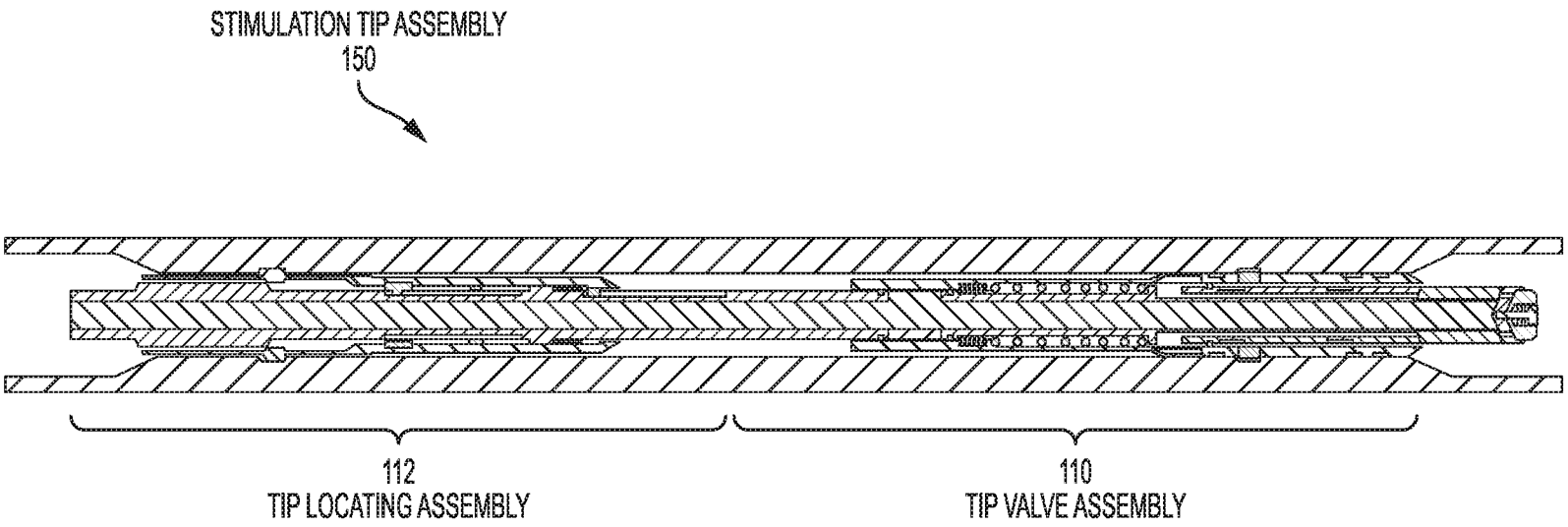
FIG. 11 is a schematic illustration of an example of a stimulation tip assembly of the zonal fracturing and flow stimulation system, according to an embodiment of the disclosure.
Figure 12:
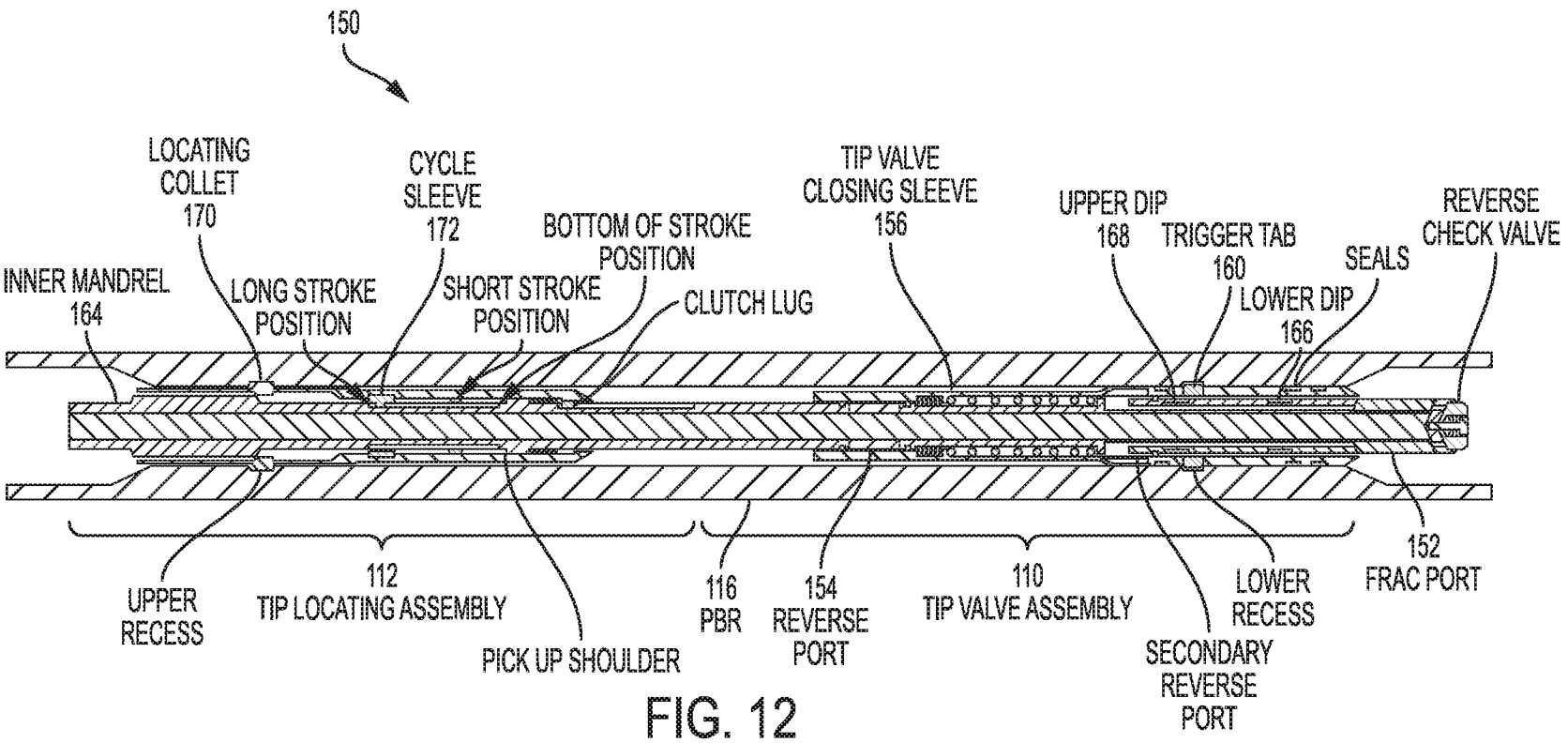
FIG. 12 is another schematic illustration of an example of a stimulation tip assembly, according to an embodiment of the disclosure.
Figure 13:
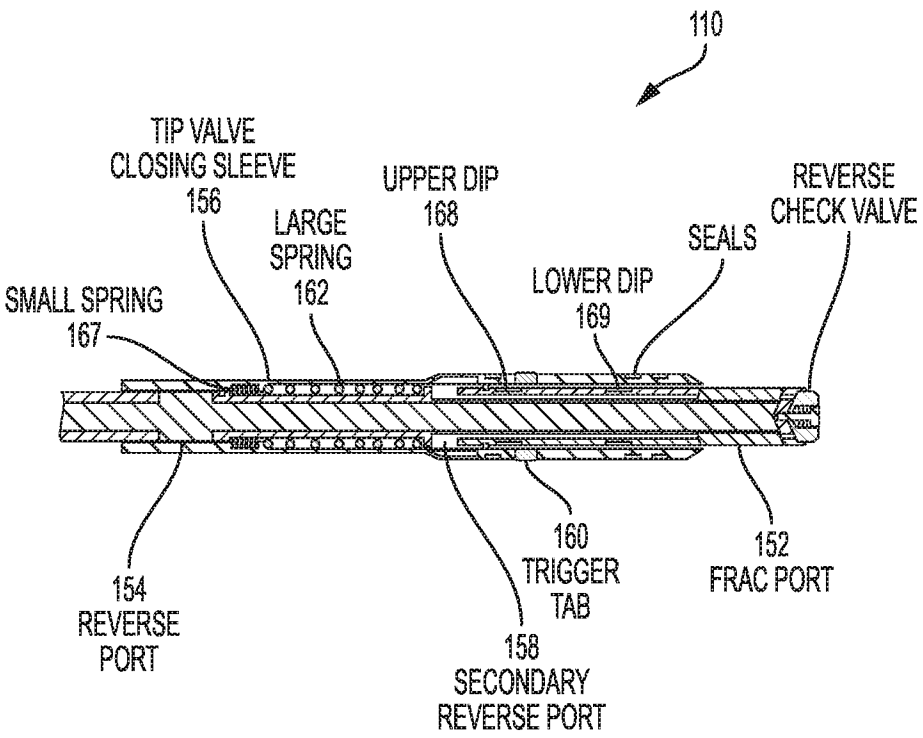
FIG. 13 is a schematic illustration of an example of a tip valve assembly of the stimulation tip assembly, according to an embodiment of the disclosure.
Figure 14:
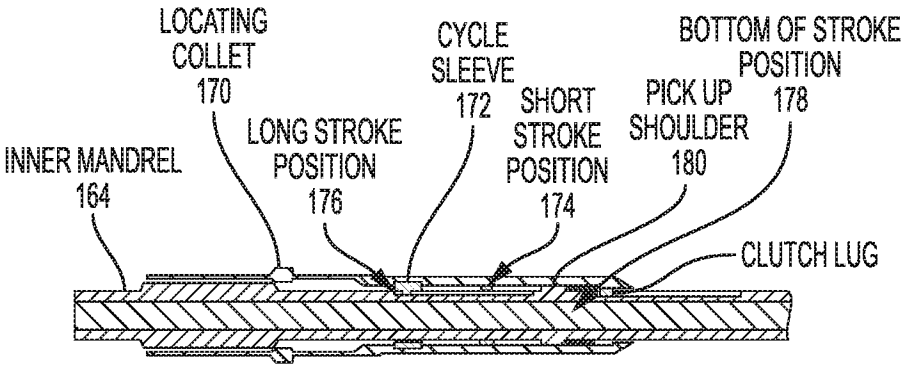
FIG. 14 is a schematic illustration of an example of a tip locating assembly of the stimulation tip assembly, according to an embodiment of the disclosure.

An example of the stimulation tip assembly 150 is illustrated in FIGS. 11 and 12 as including a tip valve assembly 110 and a tip locating assembly 112. The tip valve assembly 110 is further illustrated in FIG. 13 and is constructed to control a change in flow path from the illustrated frac port 132 to the reverse port 154 by manipulating an outer tip valve closing sleeve 156 to selectively open and close the frac and reverse ports, as illustrated in FIG. 12. The tip locating assembly 112 is further illustrated in FIG. 14 and is used to control the position of the tip valve assembly 110 and thus the stimulation tip in the well. The tip locating assembly enables use of weight indications to track where the tip is and also allows for a weight down mode to maintain the position of the tip valve assembly 110 and the tip valve assembly configuration with respect to frac and reverse positions.

Referring again to FIG. 13, an embodiment of the tip valve assembly 110 may comprise a gravel pack type cross-over tool with the frac ports on the down end and gun drilled holes (see, e.g., FIG. 47B) for the secondary reverse port 158 or ports. To close the frac ports 152, a closing sleeve slides over the frac ports. This same tip valve closing sleeve 156 also opens and covers the reverse port 154. The tip valve closing sleeve 156 is constructed such that when the frac port 152 is uncovered the reverse port 154 is covered and when the frac port is covered the reverse port is uncovered, thus enabling selective shifting of the tip valve assembly 110 back and forth between frac mode and reverse circulating mode. A trigger tab 160 may be used to control the position of the sliding sleeve 156 and a large spring 162 may be used to keep the tip valve closing sleeve 156 in a default position, e.g. a default forward circulating frac mode, as illustrated.

When the tip valve assembly 110 enters a restriction, e.g. the PBR 116, the trigger tab 160 holds the closing sleeve 156 down while an inner mandrel 164 moves up to allow tabs to recess into a lower dip 166 in the mandrel, thus locking the tool in a reverse circulating mode. In this mode, the large spring 162 is compressed and biases the tool to revert to a forward circulating frac mode. When moving down into a restriction from above a PBR 116, the trigger tab 160 holds the closing sleeve 156 momentarily until the illustrated small spring 166 is compressed and the tabs are recessed inside an upper dip 168 in the mandrel to allow the tool to go into the PBR. In this latter movement, the tip valve closing sleeve 156 has simply moved up slightly relative to the inner mandrel 164 so the tool remains in the forward circulate frac mode.

Referring again to FIG. 14, an embodiment of the tip locating assembly 112 is illustrated as having a collet/collet sleeve 170 that is clutched and slides back and forth over an inner mandrel 164 with an upset. A cycle sleeve 172 rotates in place along an infinite J-slot cut into the inner mandrel. In this example, the J-slot has a short stroke position 174 and a long stroked position 176. In the short stroke position 174, the cycle sleeve 172 no-goes against a castellation on the inner mandrel 164, thus limiting the relative motion of a locating collet 170, e.g. the collet may collapse and go through a restriction such as the PBR 116. In the long stroke position, the cycle sleeve 172 has rotated to allow it to pass the castellation which allows the inner mandrel to travel pass the short stroke position down to the longer stroke position. In the long stroke position 176, the upset on the inner mandrel no-goes underneath the collet forming a substantial no-go weight down position. Accordingly, when the locating collet is landed inside one of the recesses in the PBR the tool can cycle back and forth between the long stroke position 176 and the short stroke position. When coming out of the hole, the tool goes to the bottom of the stroke 178 and a pick up shoulder 180 picks up the unsupported sleeve and allows the collet to collapse and pass through restrictions.

Figure 15:
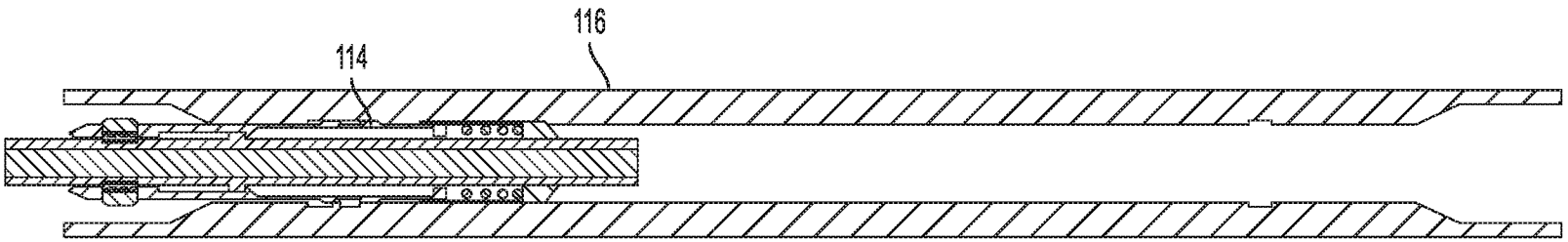
FIG. 15 is a schematic illustration of an example of a resettable shifting assembly of the zonal fracturing and flow stimulation system, according to an embodiment of the disclosure.
Figure 16:
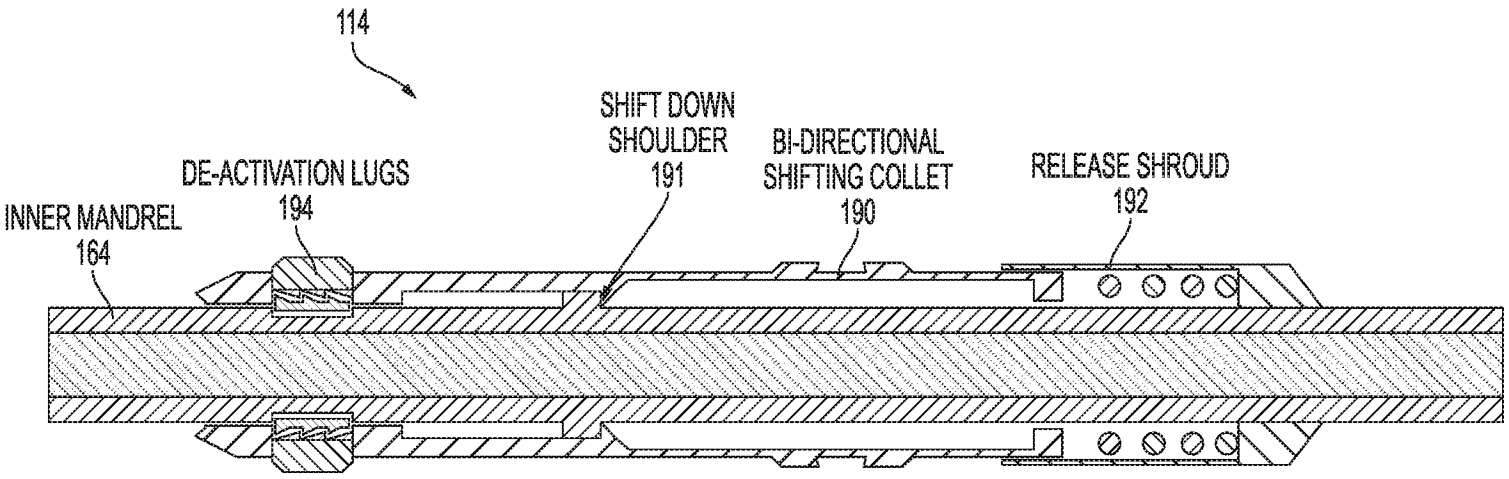
FIG. 16 is a schematic illustration of the resettable shifting assembly in an active mode, according to an embodiment of the disclosure.
Figure 17:
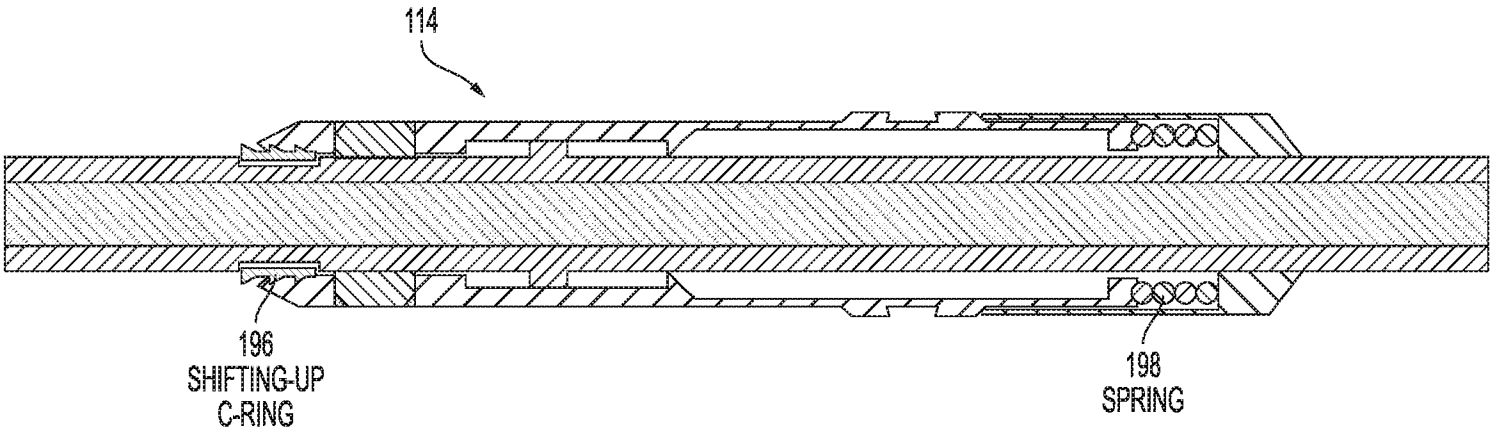
FIG. 17 is a schematic illustration of the resettable shifting assembly in a de-active mode, according to an embodiment of the disclosure.

Referring generally to FIG. 15, an embodiment of a resettable shifting assembly 114 is illustrated. The resettable shifting assembly 114 serves as a tool which shifts down sleeves with a mating profile. However, shifting up depends on two possible modes of the tool which may be referred to as an active mode (see FIG. 16) and a de-active mode (see FIG. 17). In the active mode, a bi-directional shifting collet 190 is locked to the inner mandrel so the collet grabs a mating profile such as sift down shoulder 191 to shift the corresponding sleeve and release from it. In the de-active mode, the illustrated bi-directional shifting collet is unlocked from the inner mandrel but held up out of a releasing shroud 192 so it is able to grab a mating profile sleeve. However, when trying to shift up the mating profile sleeve the collet is unlocked from the inner mandrel and is forced down into the releasing shroud causing the collet to collapse and thus to release the corresponding sliding sleeve.

The resettable shifting assembly 114 goes into the unlocked position when it comes up through a restriction, e.g. the PBR 116. This happens because deactivation-lugs 194 are forced inwardly to travel through the PBR. The depressed lugs 194 collapse the illustrated shift-up C-ring 196 to unlock the two layers. The resettable shifting assembly 114 may be reset to the active mode by setting down on top of a restriction, e.g. the PBR 116. The collet 190, e.g. collet sleeve, is held up on top of the PBR 116 unless sufficient force is provided to collapse the collet and move it inside the PBR. This allows the inner mandrel to move down relative to the shifting collet sleeve to re-latch the shift-up C-ring inside the inner mandrel. The second method for resetting the tool is to move up past the zonal frac and flow sleeve and to then set down against the sleeve to re-activate the tool. Immediately after re-activating the collet, the assembly is picked up to shift open the zonal frac and flow assembly to restart the whole process. As illustrated best in FIG. 16, when moving up through the PBR the de-activation lugs press inwardly and collapse the shift-up C-ring causing the tool to become de-activated. In the de-active mode, the shifting collet is pushed down against the spring and into the release shroud collapsing the shifting collet and releasing it from the sleeve it was trying to shift. As illustrated best in FIG. 17, the tool may be re-locked by pushing the shifting collet against the top of the PBR while pushing the inner mandrel down. The spring 198 helps to keep the bi-directional shifting collet 190 outside the releasing shroud 192, thus keeping the collet in the expanded state looking for something to shift.

Figure 18:
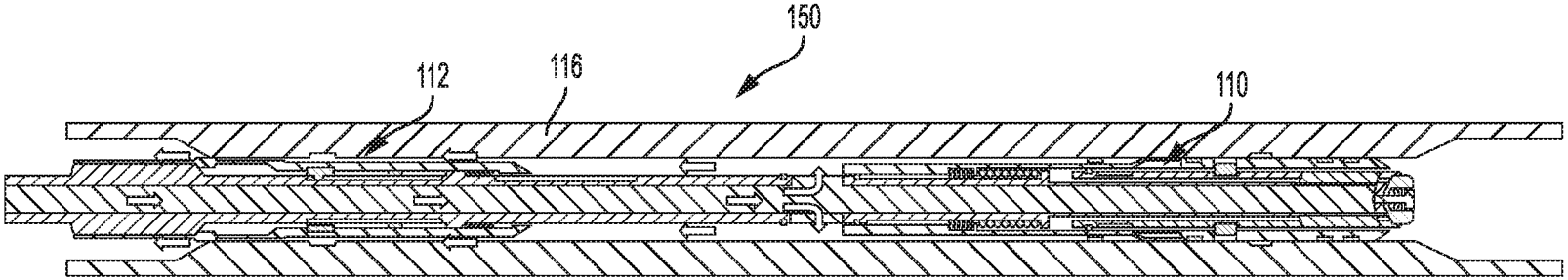
FIG. 18 is a schematic illustration of the stimulation tip assembly in an operational configuration, according to an embodiment of the disclosure.
Figure 19:
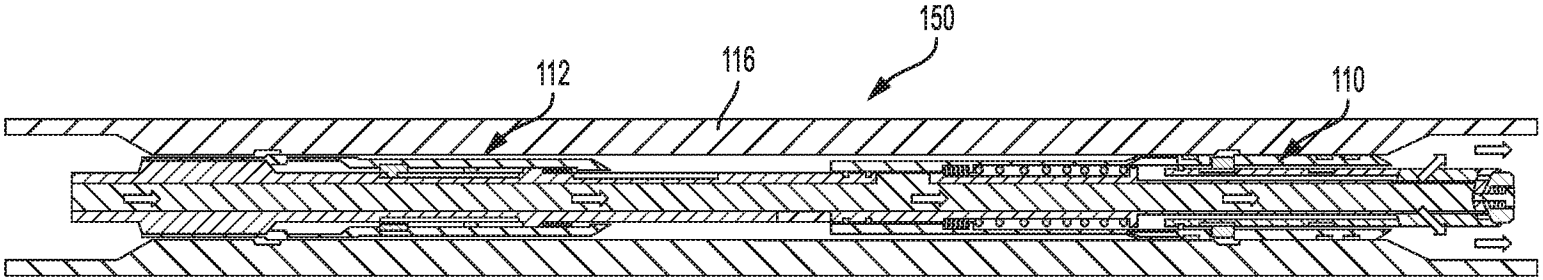
FIG. 19 is a schematic illustration of the stimulation tip assembly in another operational configuration, according to an embodiment of the disclosure.
Figure 20:
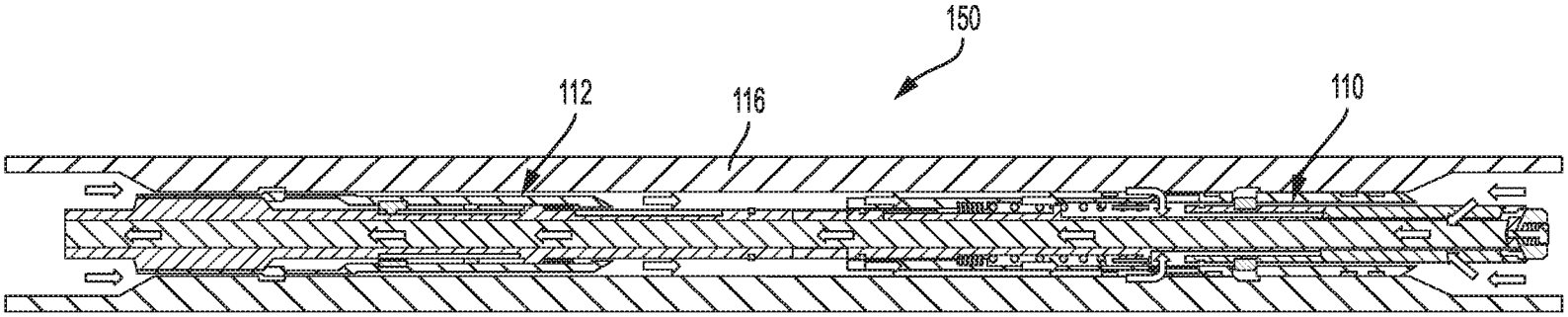
FIG. 20 is a schematic illustration of the stimulation tip assembly in another operational configuration, according to an embodiment of the disclosure.
Figure 21:
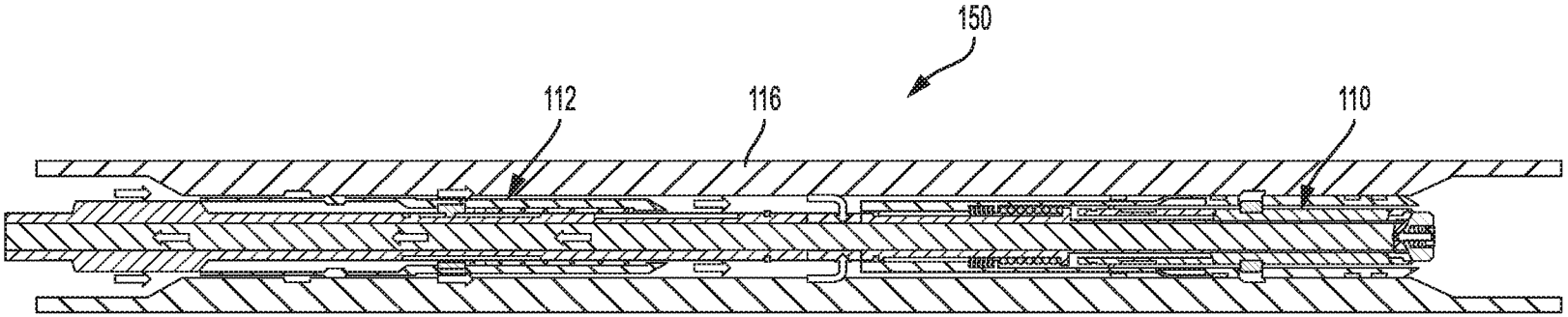
FIG. 21 is a schematic illustration of the stimulation tip assembly in another operational configuration, according to an embodiment of the disclosure.

Referring generally to FIGS. 18-21 various flow paths are illustrated when the stimulation tip assembly 150 is placed in a desired modes. For example, the stimulation tip assembly 150 may be selectively placed in a mode to spot fluid, as illustrated in FIG. 18. The stimulation tip assembly may then be shifted to a stimulate fracture mode, as illustrated in FIG. 19. Subsequently, the stimulation tip assembly 150 may be shifted to a clean-out reverse mode, as illustrated in FIG. 20. The stimulation tip may then be shifted to a reverse circulate mode, as illustrated in FIG. 21.

Figure 22:
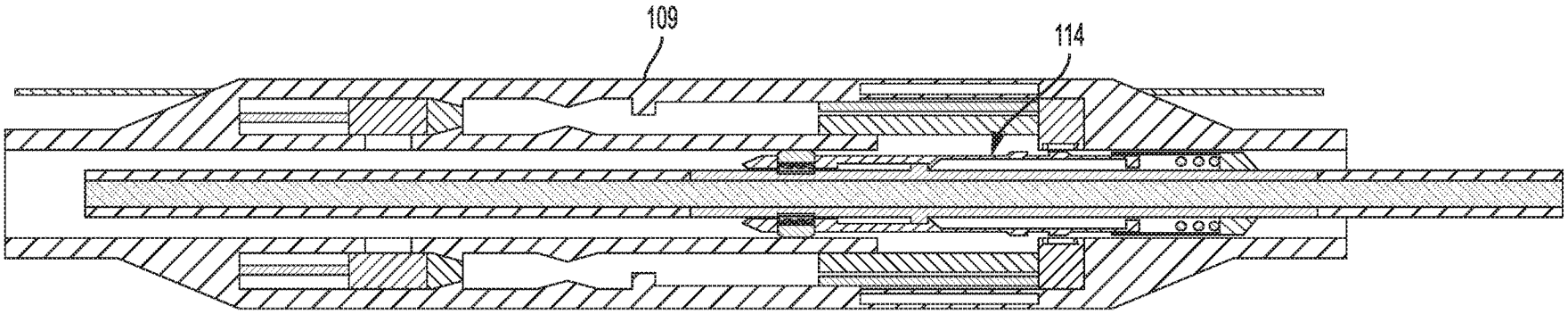
FIG. 22 is a schematic illustration of a portion of the zonal fracturing and flow stimulation system in a stage of an operational fracturing stimulation workflow sequence, according to an embodiment of the disclosure.

The zonal frac and flow system may be used in a variety of environments and with a variety of workflow sequences. However an example of an operational frac stimulation workflow sequence is illustrated in FIGS. 22-44. In this example, the zonal frac and flow valve assembly 109 is initially shifted to an open position, as illustrated in FIG. 22. The process is initiated by picking up the shifting tool 110 in the active mode to shift open the zonal frac and flow valve 109. The zonal frac and flow sleeve is constructed to provide an indication of shifting. With respect to state of the tools, the frac tip valve assembly 114 is below the frac valve and in the natural state the frac tip assembly remains in the forward circulate frac mode. The tip locating assembly 112 also is below the frac valve and its state depends on the cycle of the previous set down stroke. The state can be easily found by setting down weight to see if it no-goes. Not weight down indicates the locating collet assembly is in the short stroke position. By picking up and subsequently slacking off, the locating collet assembly is placed in the weight down mode. By setting down on the PBR, the resettable shifting assembly 112 is in the active mode seeking to shift the sleeves up.

Figure 23:
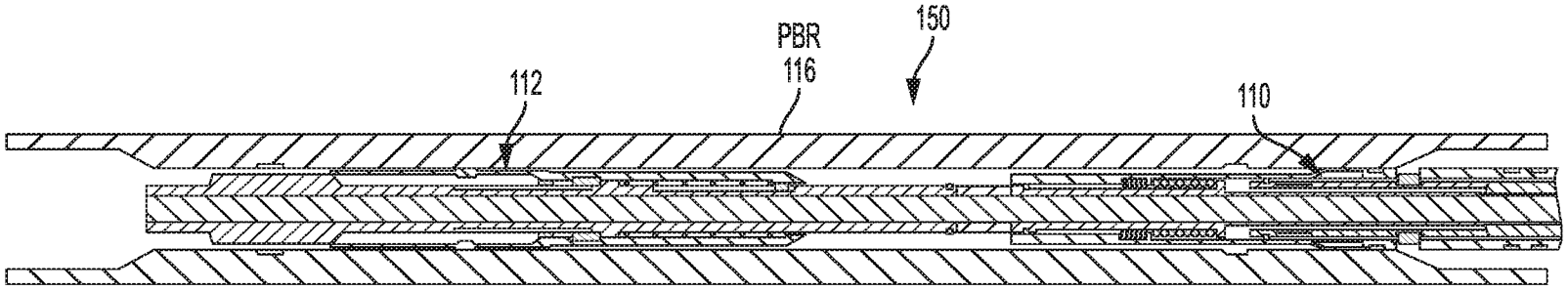
FIG. 23 is a schematic illustration of a portion of the zonal fracturing and flow stimulation system in another stage of the operational fracturing stimulation workflow sequence, according to an embodiment of the disclosure.

The system is then picked up from the bottom of the PBR 116 toward a spot fluid position after closing the stimulated zonal frac and flow valve 109, as illustrated in FIG. 23. The locating collet 170 indicates against the bottom of the PBR 116; the lower recess and the upper recess. With respect to the state of the tools, the trigger tab 160 enters the PBR from below and the outer sleeve is held down while the inner mandrel moves up, thus allowing the trigger tabs to recess down inside the lower dip. The action closes the tip port and opens the reverse port. Additionally, picking up the frac string places the tip locating assembly 112 in the bottom of the stroke. Two weight indications are seen as the locating collet pulls through two recesses inside the PBR. The resettable shifting assembly 112 is run above the frac tip assembly and picking up the resettable shifting assembly 112 through the PBR places this tool in the deactivate mode.

Figure 24:
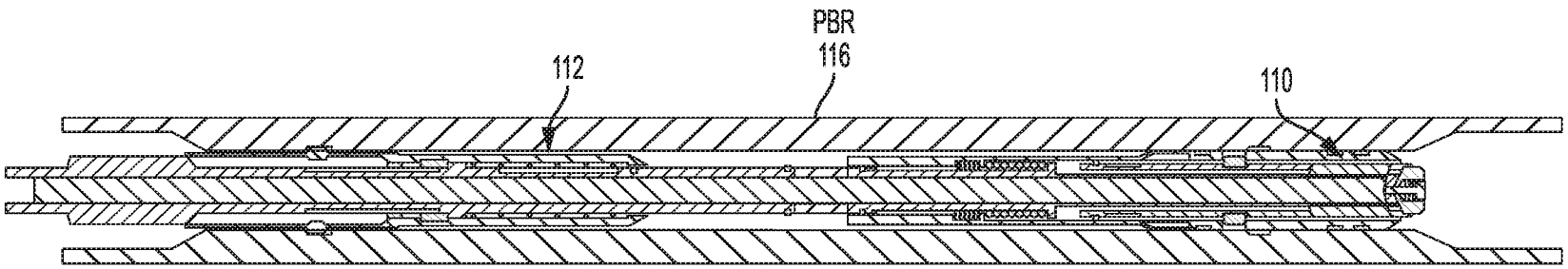
FIG. 24 is a schematic illustration of a portion of the zonal fracturing and flow stimulation system in another stage of the operational fracturing stimulation workflow sequence, according to an embodiment of the disclosure.
Figure 25:
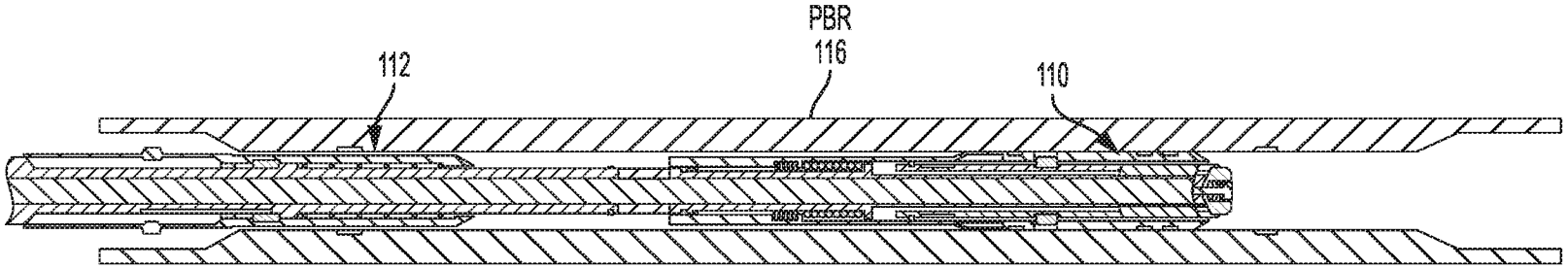
FIG. 25 is a schematic illustration of a portion of the zonal fracturing and flow stimulation system in another stage of the operational fracturing stimulation workflow sequence, according to an embodiment of the disclosure.

This pick up motion is continued until the locating assembly is above the PBR and moved to a spot fluid position, as illustrated in FIG. 24. The pick up motion locates the collet up past the upper recess and an indication is provided when the locating collet pulls through the upper recess. With respect to the state of the tools, the tip valve of the frac tip valve assembly 110 remains inside the PBR and thus remains in the reverse circulate mode. Picking up the string places the tip locating assembly 112 in the bottom of the stroke. The resettable shifting assembly 112 remains above the PBR and in the de-activated mode. At this stage weight may be set down on top of the PBR to establish the spot fluid position, as illustrated in FIG. 25. The locating collet indicates against the top of the PBR which allows the system to take on slack off weight. With respect to the state of the tools, the tip valve remains inside the PBR and remains in the reverse circulate mode. The first slack off places the tip locating assembly 112 in the weight down mode (long stroke position) so the tool will no-go on top of the PBR. The resettable shifting assembly 112 remains above the PBR and in the deactivated mode.

Figure 26:
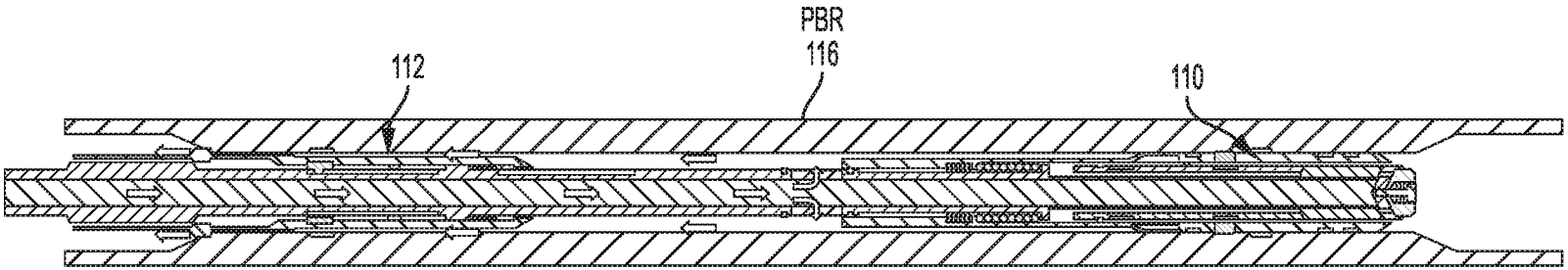
FIG. 26 is a schematic illustration of a portion of the zonal fracturing and flow stimulation system in another stage of the operational fracturing stimulation workflow sequence, according to an embodiment of the disclosure.

While holding weight down, fluid is pumped down through the tubing to spot fluid while the assembly is held in the spot fluid position, as illustrated in FIG. 26. The position may be indicated via hydraulic tubing to annulus communication. With respect to the state of the tools, the tip valve of the frac tip valve assembly 110 remains inside the PBR and in the reverse circulate mode. Putting weight down against the top of the PBR keeps the tip of the tip locating assembly 112 stationary while spotting the fluid. The resettable shifting assembly 112 remains above the PBR and in the deactivated mode.

Figure 27:
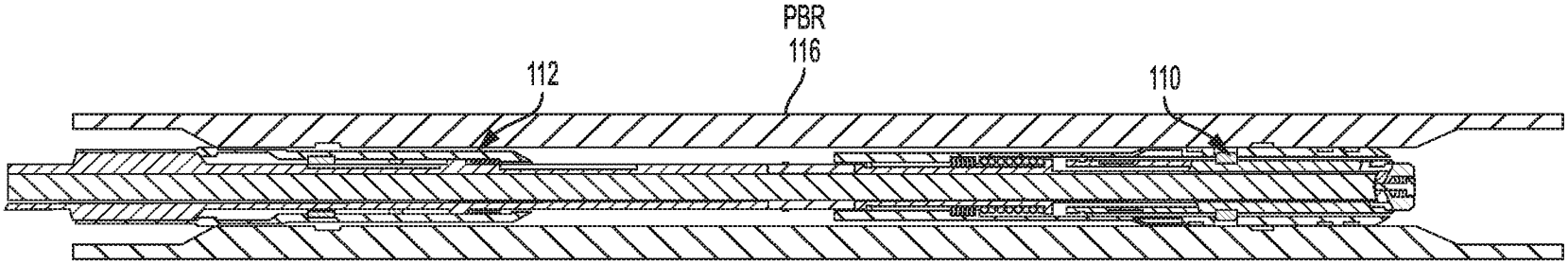
FIG. 27 is a schematic illustration of a portion of the zonal fracturing and flow stimulation system in another stage of the operational fracturing stimulation workflow sequence, according to an embodiment of the disclosure.
Figure 28:
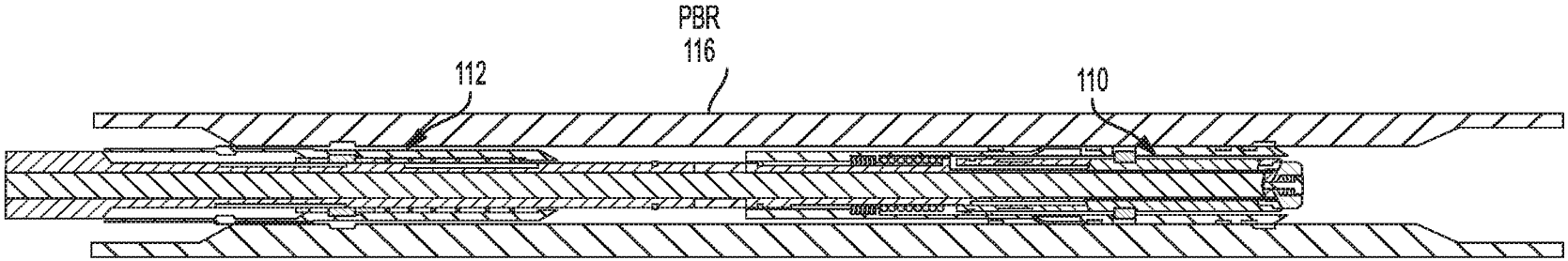
FIG. 28 is a schematic illustration of a portion of the zonal fracturing and flow stimulation system in another stage of the operational fracturing stimulation workflow sequence, according to an embodiment of the disclosure.
Figure 29:
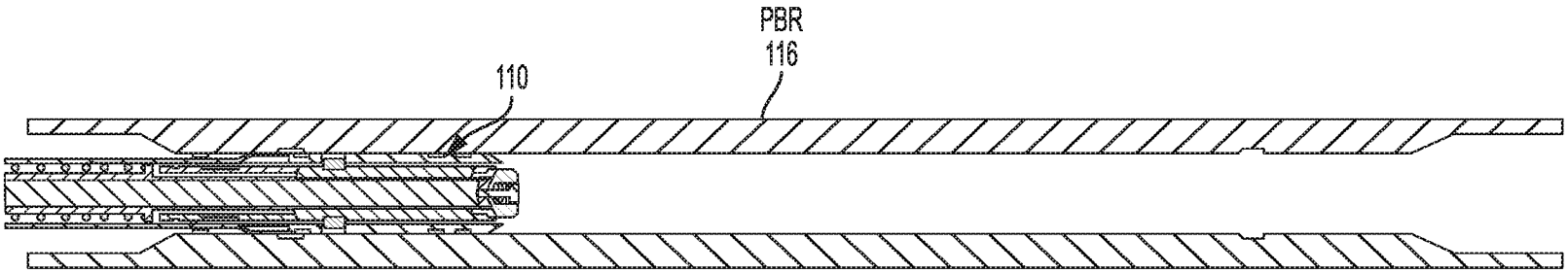
FIG. 29 is a schematic illustration of a portion of the zonal fracturing and flow stimulation system in another stage of the operational fracturing stimulation workflow sequence, according to an embodiment of the disclosure.
Figure 30:
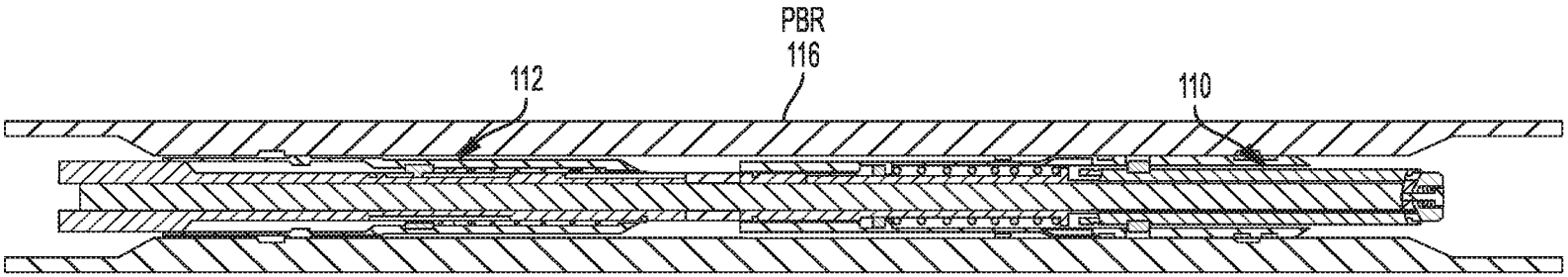
FIG. 30 is a schematic illustration of a portion of the zonal fracturing and flow stimulation system in another stage of the operational fracturing stimulation workflow sequence, according to an embodiment of the disclosure.

Subsequently, the frac tip assembly is picked up above the PBR to the reset position, as illustrated in FIGS. 27 and 28. An indication is provided via a tubing tally to confirm a fixed distance past snapping through the upper recess. With respect to the state of the tools, the tip valve remains inside the PBR and in the reverse circulate mode. Picking up and removing the weight down cycles the tip locating assembly 112 which is ready to go to the short stroke position. The resettable shifting assembly 112 remains above the PBR and in the deactivated mode. The frac tip assembly is then pushed back down into the PBR, as illustrated in FIGS. 29 and 30. A weight indication is provided when the locating collet enters the PBR and a second weight indication is provided when the locating collet lands inside the upper recess. In this state, there is hydraulic isolation from tubing to annulus but hydraulic flow from annulus to tubing is possible. With respect to the state of the frac tip valve assembly 110, as the trigger tab re-enters the PBR from above the outer sleeve is held up slightly to recess the tab. This keeps the tip port open and the reverse port closed. The second slack off places the tip locating assembly 112 in the short stroke allowing the collet to collapse and re-enter the PBR. An indication is seen once the collet locates the first recess. The resettable shifting assembly 112 remains above the PBR and in the deactivated mode.

Figure 31:
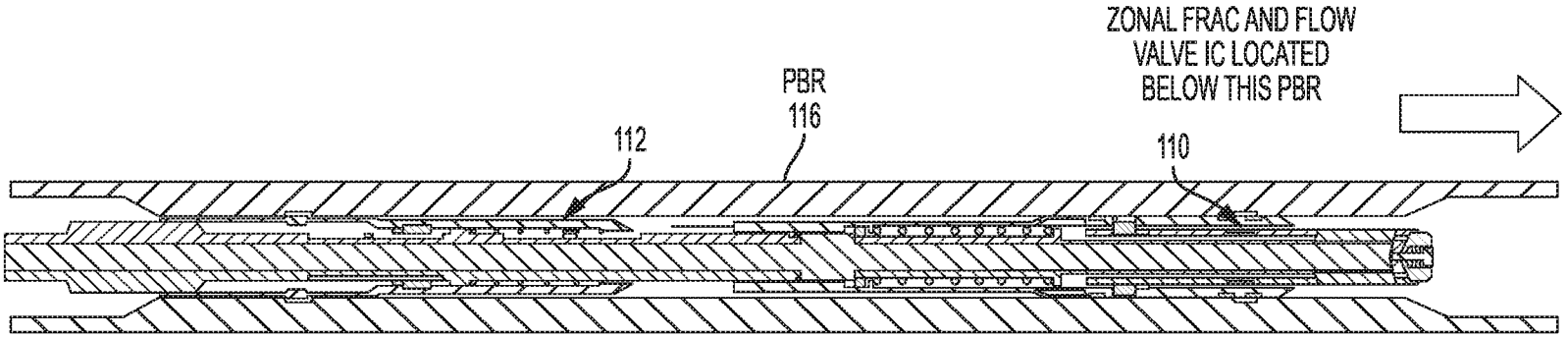
FIG. 31 is a schematic illustration of a portion of the zonal fracturing and flow stimulation system in another stage of the operational fracturing stimulation workflow sequence, according to an embodiment of the disclosure.
Figure 32:
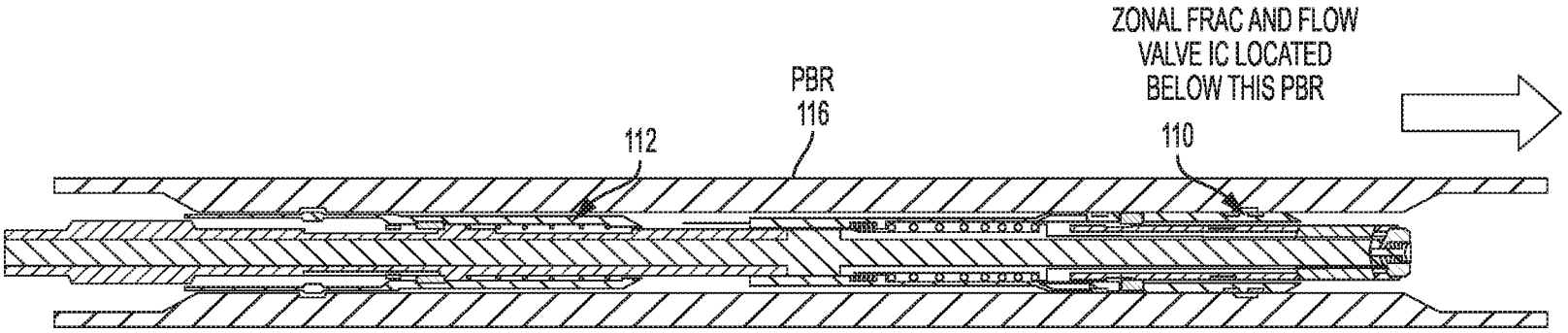
FIG. 32 is a schematic illustration of a portion of the zonal fracturing and flow stimulation system in another stage of the operational fracturing stimulation workflow sequence, according to an embodiment of the disclosure.
Figure 33:
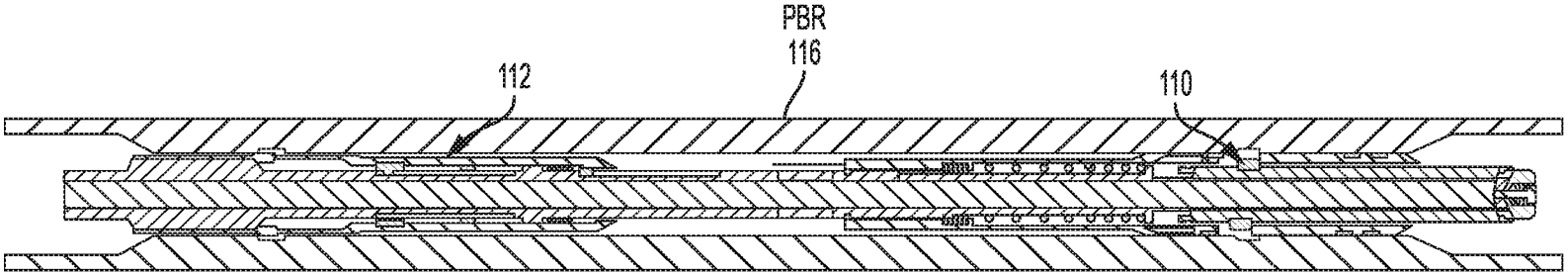
FIG. 33 is a schematic illustration of a portion of the zonal fracturing and flow stimulation system in another stage of the operational fracturing stimulation workflow sequence, according to an embodiment of the disclosure.
Figure 34:
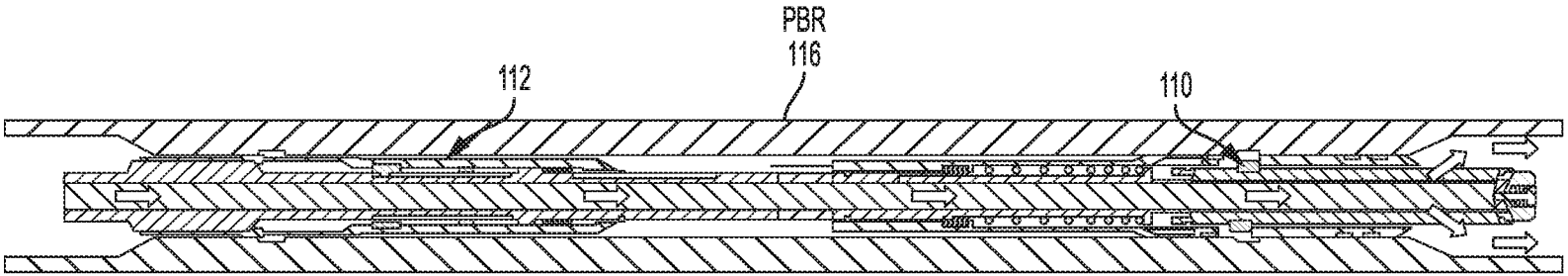
FIG. 34 is a schematic illustration of a portion of the zonal fracturing and flow stimulation system in another stage of the operational fracturing stimulation workflow sequence, according to an embodiment of the disclosure.

The assembly is then again picked up to cycle the locating assembly (bottom of stroke) to move the assembly toward the frac position, as illustrated in FIG. 31. The tip valve assembly 110 is picked up to cycle the locating tool. An indication is provided via pick up against the locating collet inside the upper recess. However, the collet should not be over pulled from the upper recess. With respect to the state of the tools, the frac tip valve assembly 110 remains in the forward circulate frac mode; tip port open and reverse port closed. Picking up from the short stroke position cycles the tip locating assembly 112 to go into the long stroke. The resettable shifting assembly 112 remains above the PBR and in the deactivated mode. Slacking off weight moves the assembly down to the frac position (long stroke), as illustrated in FIGS. 32 and 33. An indication is provided by the no-go against the locating collet in the weight down mode. With respect to state of the tools, the frac tip valve assembly 110 remains in the forward circulate frac mode with tip port open and reverse port closed. The tip locating assembly 112 slacks off in the long stroke weight down mode. The resettable shifting assembly 112 remains above the PBR and in the deactivated mode. In this position, fracturing fluid is pumped down through the tubing and out to the frac ports as illustrated in FIG. 34. An indication is provided by the no-go against the locating collet in the weight down mode. With respect to state of the tools, the frac tip valve assembly 110 remains in the forward circulate frac mode with tip port open and reverse port closed. The tip locating assembly 112 is in the hold weight down position. The resettable shifting assembly 112 remains above the PBR and in the deactivated mode.

Figure 35:
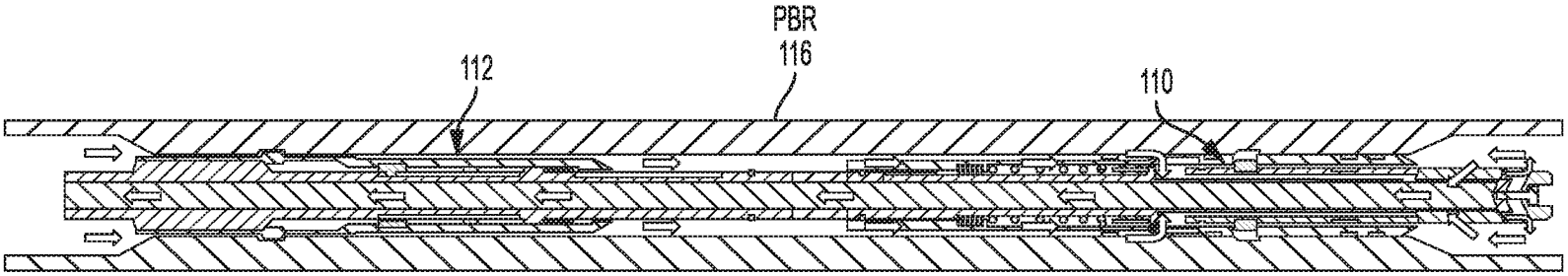
FIG. 35 is a schematic illustration of a portion of the zonal fracturing and flow stimulation system in another stage of the operational fracturing stimulation workflow sequence, according to an embodiment of the disclosure.

Subsequently, in the weight down frac position fluid may be pumped down the annulus through a secondary reverse port, as illustrated in FIG. 35. After stimulation, the weight down position is held and fluid is pumped down the annulus to start reversing out the excess frac fluid. This is an optional cleanout which allows purging the frac fluid from the tip tool between the frac port and reverse port and also allows clean up around the tip tool prior to pulling up in the reverse mode. An indication is provided by the no-go against the locating collet in the weight down mode. Hydraulic flow is isolated from tubing to annulus but possible from annulus to tubing. With respect to the state of the tools, the frac tip valve assembly 110 remains in the forward circulate mode with tip port open and reverse port closed. The tip locating assembly 112 is in a hold weight down position, and the resettable shifting assembly 112 remains above the PBR in a deactivated mode. It should be noted the secondary reverse port allows for reversing out through a PBR or restriction where flow around the outside of the frac tip is not possible, e.g. when going through a PBR. In an example, a vertical well may have a PBR halfway packed with sand. Unless a flow path to the bottom of the tip valve is provided below the seals (e.g. the secondary ports described herein) it would not be possible to make forward progress of the tool because it would not be possible to wash proppant out ahead of the tool tip.

Figure 36:
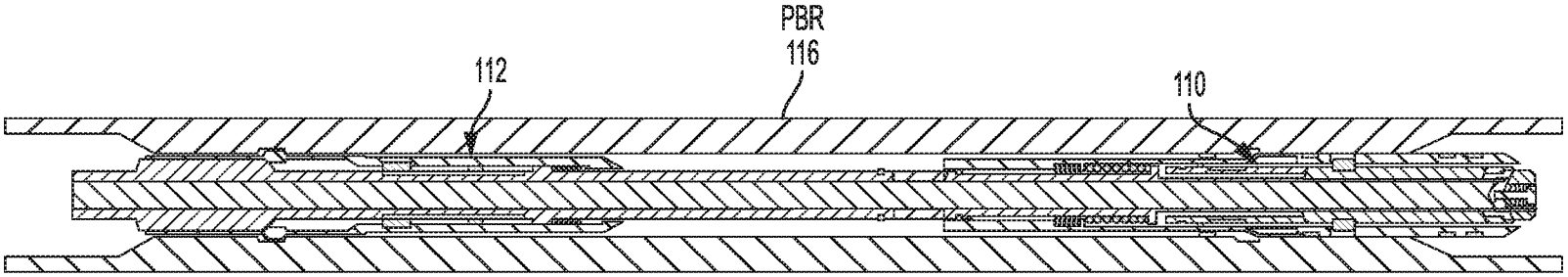
FIG. 36 is a schematic illustration of a portion of the zonal fracturing and flow stimulation system in another stage of the operational fracturing stimulation workflow sequence, according to an embodiment of the disclosure.
Figure 37:
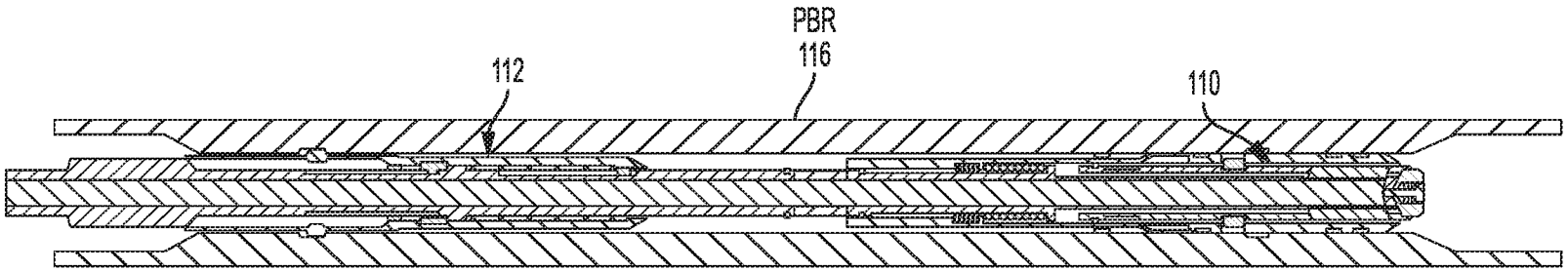
FIG. 37 is a schematic illustration of a portion of the zonal fracturing and flow stimulation system in another stage of the operational fracturing stimulation workflow sequence, according to an embodiment of the disclosure.
Figure 38:
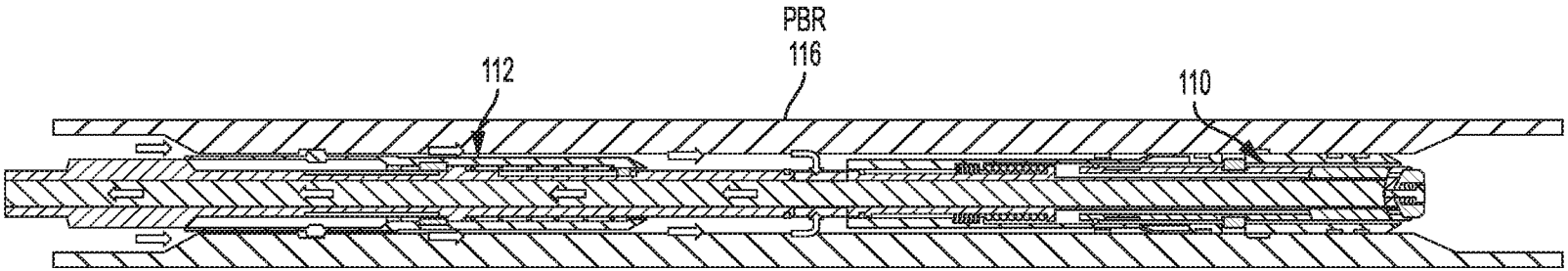
FIG. 38 is a schematic illustration of a portion of the zonal fracturing and flow stimulation system in another stage of the operational fracturing stimulation workflow sequence, according to an embodiment of the disclosure.

The assembly may again be picked up toward a reverse position (bottom of stroke) as illustrated in FIGS. 36 and 37. While pumping down the annulus, the pick up isolates the tubing and converts the assembly to a reverse circulate mode. An indication is provided by the locating collet which indicates against the upper recess inside the PBR. Hydraulically, the back pressure from annulus to tubing drops once the tool is converted to the reverse circulate mode. With respect to the frac tip valve assembly 110, the trigger tab is inside the lower recess so the outer sleeve is held down while the mandrel travels up, thus closing the tip port and opening the reverse port. Picking up the string places the tip locating assembly 112 in the bottom of the stroke. The resettable shifting assembly 112 remains above the PBR and in the deactivated mode. This enables reverse circulation of fluid in a reverse circulate configuration, as illustrated in FIG. 38. Pump down is continued through the annulus to fully reverse out the excess frac fluid. An indication is provided by the locating collet which indicates against the upper recess inside the PBR.

Figure 39:
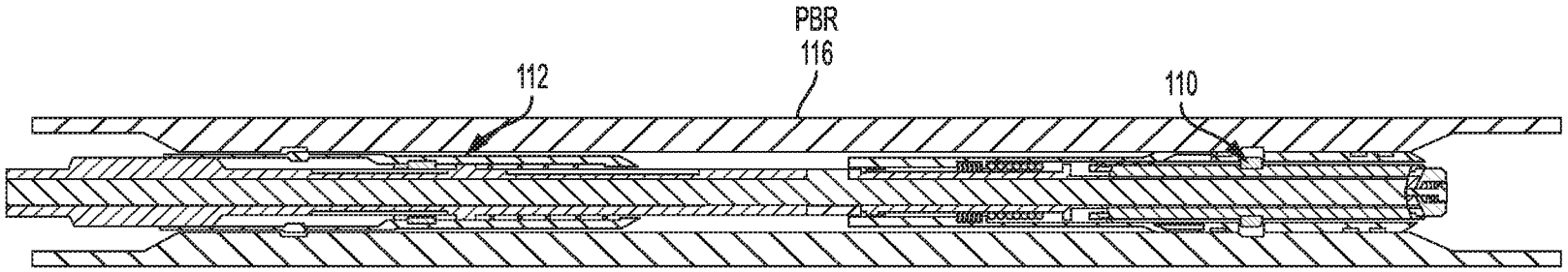
FIG. 39 is a schematic illustration of a portion of the zonal fracturing and flow stimulation system in another stage of the operational fracturing stimulation workflow sequence, according to an embodiment of the disclosure.
Figure 40:
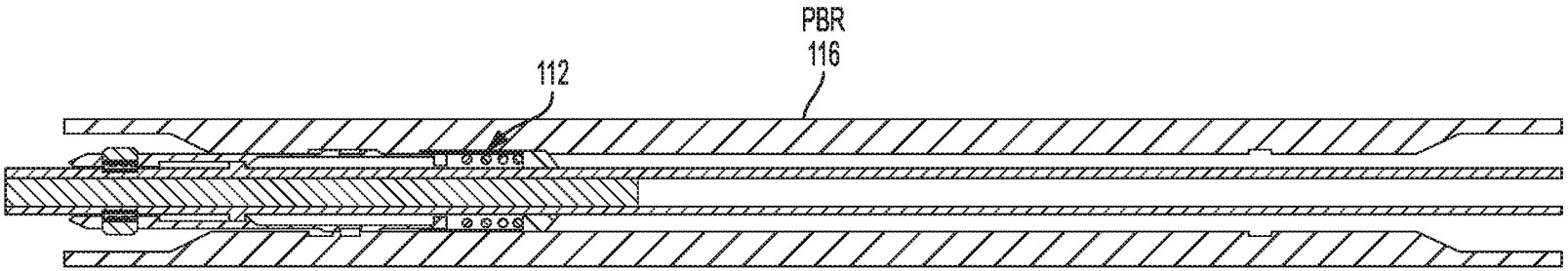
FIG. 40 is a schematic illustration of a portion of the zonal fracturing and flow stimulation system in another stage of the operational fracturing stimulation workflow sequence, according to an embodiment of the disclosure.

A push may then be applied for movement down through the PBR, as illustrated in FIGS. 39 and 40. While continually pumping down through the annulus to reverse circulate, weight is slacked off through the PBR. A weight indication is provided through the upper recess and the lower recess. After the seals exit the PBR, the hydraulic communication is changed from reversing through the reverse port to reversing through the bottom frac ports. With respect to the state of the tools, as the frac tip valve exits the bottom of the PBR the tip valve closing sleeve snaps up to a forward circulating frac mode in which the tip port is open and the reverse port is closed. A second slack off places the tip locating assembly 112 in the short stroke position which allows the locating collet to collapse and pass through the PBR. When moving down through the PBR, the resettable shifting assembly 112 re-locks to active mode.

Figure 41:
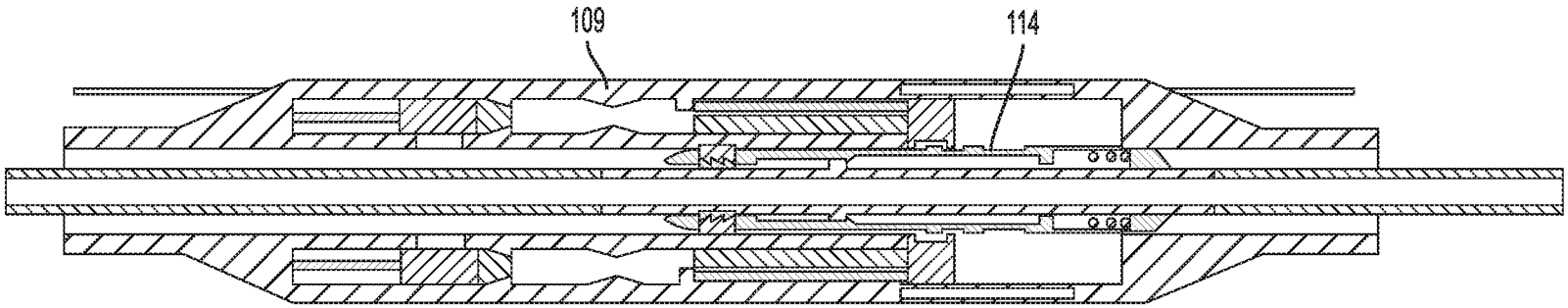
FIG. 41 is a schematic illustration of a portion of the zonal fracturing and flow stimulation system in another stage of the operational fracturing stimulation workflow sequence, according to an embodiment of the disclosure.
Figure 42:
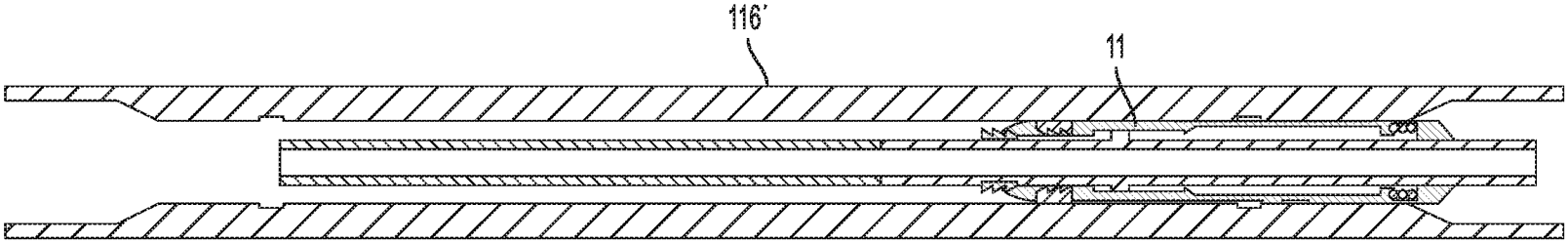
FIG. 42 is a schematic illustration of a portion of the zonal fracturing and flow stimulation system in another stage of the operational fracturing stimulation workflow sequence, according to an embodiment of the disclosure.

As a result, the zonal frac and flow valve assembly may be shifted, as illustrated in FIG. 41, to a closed position. When moving down, the resettable shifting assembly 112 is active and shifts sleeves down. Subsequently, the shifting assembly is pulled up through the PBR to deactivate, as illustrated in FIG. 42. For example, after closing the valve assembly the shifting tool may be pushed down to the PBR and then back up to the PBR to deactivate the shifting tool. An indication is provided by the locating collet which passes through the PBR first and then moves a given distance until the shifting tool is through. Once deactivated, the shifting tool does not shift additional sleeves on the way up. With respect to the state of the tools, the frac tip valve assembly 110 is in the forward circulate frac mode when in the large ID casing. The tip locating on every second set down goes into the no-go mode but comes out of hole easily because the locating tool collet collapses through each restriction. When pulled up through the PBR, the resettable shifting assembly 112 goes to the deactivate mode.

Figure 43:
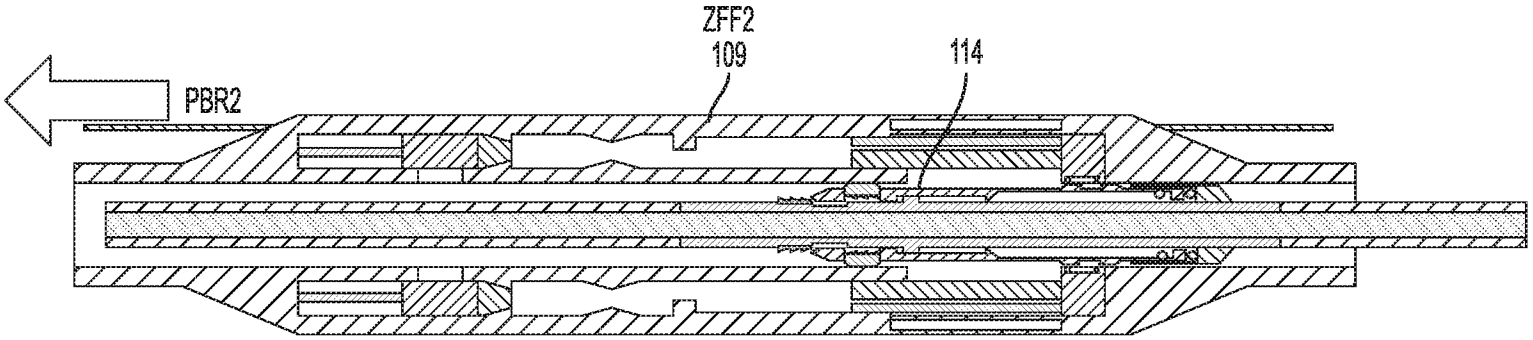
FIG. 43 is a schematic illustration of a portion of the zonal fracturing and flow stimulation system in another stage of the operational fracturing stimulation workflow sequence, according to an embodiment of the disclosure.
Figure 44:
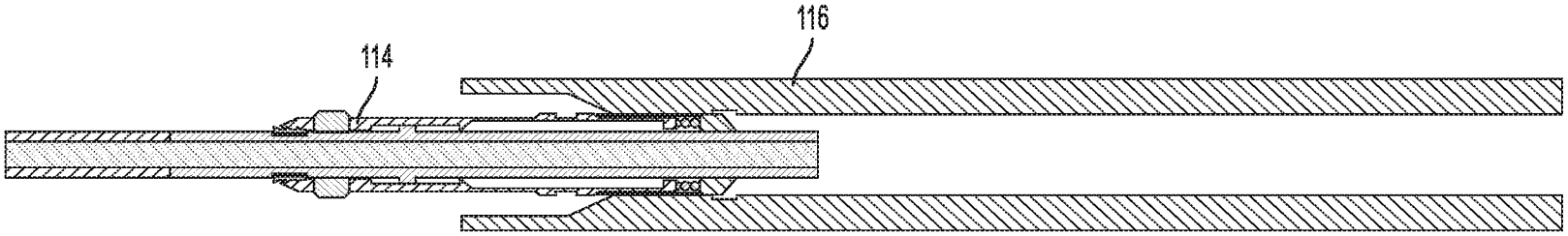
FIG. 44 is a schematic illustration of a portion of the zonal fracturing and flow stimulation system in another stage of the operational fracturing stimulation workflow sequence, according to an embodiment of the disclosure.

When desired, the assembly may be set down to reactivate the shifting assembly, as illustrated in FIGS. 43 and 44. The process is started by picking up the shifting tool above the next sequential zonal fracture and flow system and then setting down on the sleeve to reset the shifting tool. A subsequent pick up is used to open the zonal fracture and flow system and to restart the entire process. The zonal fracture and flow sleeve is constructed to provide an indication of shifting, and the indication will be seen when trying to shift the sleeve open to perform the next stage of fracturing. With respect to the state of the tools, the frac tip valve assembly 110 is below the frac valve and in the natural state of forward circulate frac mode. The tip locating assembly 112 also is below the frac valve and its position depends on the previous set down stroke. The position can be determined by setting down weight to determine if it no-goes. Additionally, by setting down on the PBR, the resettable shifting assembly 112 is in an active mode seeking to shift sleeves. It should be noted that the workflow sequence illustrated and described with respect to FIGS. 22-44 is provided as an example and other workflow sequences may be selected according to the parameters of a given stimulation and production application.

Depending on the application, the zonal fracture and flow system architecture described herein may provide a variety of benefits. For example, the one trip zonal frac and flow control valves: avoid a high risk separate trip to install a zonal flow control string inside a frac valve; geometrically allow for zonal flow control inside the zonal frac sleeve; and do not utilize a separate well isolation device. Additionally, the integrated frac valve and flow control operate to: shorten the frac valve substantially by integrating the screen and sliding sleeve; provide a no screen position which eliminates another dedicated run to shift the screen positioned; and may serve as a temporary well barrier.

Additionally, the stimulation tip assembly is able to provide full ID frac flow rates while isolating the frac pressure to a position below the frac tool. The stimulation tip assembly also is able to spot fluid instead of bull heading as well as isolating the reservoir while reversing. The stimulation tip assembly also is able to reverse clean out seal bores and/or sumps of sand and further may provide features for locating and controlling the frac tip while pumping. The integrated resettable shifting assembly 112 is simpler by providing a single shifting tool rather than multiple shifting tools. For example, the resettable shifting assembly 112 does not utilize a separate screen shifting tool. Additionally, the resettable shifting tool simplifies the operational frac sequence procedure.

Furthermore, the zonal fracture and flow system architecture reduces pumping friction in the system that utilizes pumping through a nearly full tubing ID. The overall architecture is simple and may be structured to utilize four assemblies as described above. The four assemblies work together to automatically sequence the operation through frac stimulation workflows, such as the workflow outlined above. A built in tool logic may be used for easy tracking of the overall operational sequence. The system also may utilize an integrated electric flow control valve which provides compartmental zonal flow control capability in fewer trips. This capability can make ultradeep completion construction cost effective. The architecture also is operationally more flexible and facilitates adjustment of last-minute space outs. The system is modular so it can add or subtract zones and space them out at the rig to simplify upfront planning.

Figure 45:
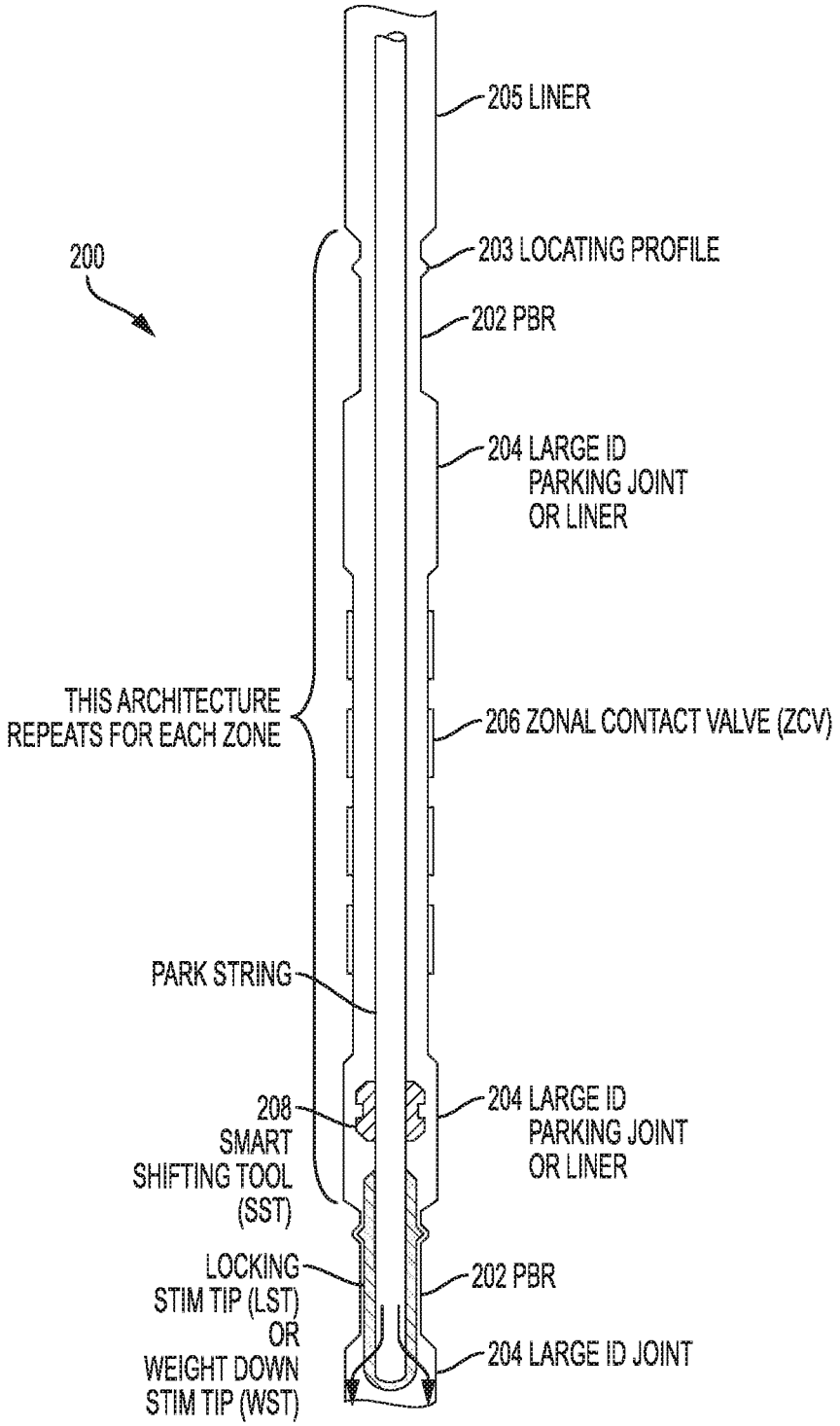
FIG. 45 is a schematic illustration of another example of the zonal fracturing and flow stimulation system, according to an embodiment of the disclosure.

Referring generally to FIG. 45, another embodiment of a single trip, selective multi-zone stimulation system 200 is illustrated to help optimize completions operations and reservoir productivity. Embodiments of the multi-zone stimulation process and system provide for an operation of stimulating a multi-zone reservoir in a single trip and to reliably control a stimulation tip tool position and flow path at a substantial distance, e.g. thousands of feet, away from the stimulation tip tool.

In this embodiment, the multi-zone stimulation system 200 comprises a zonal contact platform, a stimulation platform, and a monitor and control platform. The zonal contact platform may also be referred to as a reservoir contact platform. The overall zonal contact platform comprises a tubular string with multiple joints that is run into the borehole of a well. The zonal contact platform can be permanently fixed into the borehole, including by cementing the zonal contact platform into the borehole. The zonal contact platform includes a 1) PBR 202 with a locating profile 203, 2) Large ID liner joint 204, and 3) a series of zonal contact valves 206 (ZCV). A ZCV 206 series includes multiple valves that are longitudinally spaced from one another in a zonal contact liner 205 that forms a part of a zonal contact string. In this embodiment, the zonal contact liner is cemented in place in the borehole and the ZCVs can be in a closed position when the zonal contact liner is cemented in the borehole. A separate series of zonal contact valves may be located in each of the two or more zones of the reservoir.

A zonal contact valve series 206 is disposed between two large ID liner joints 204, as shown in FIG. 45. The two large ID joints 204 also may be referred to as a large ID parking joint or large ID parking liner. The two large ID joints 204 include an upper or first large ID liner joint and a lower or second large ID liner joint. Below the lowermost or last ZCV series 206 is at least one large ID liner joint 204. This pattern may be repeated in every zone that will be stimulated. At the bottom of the last zone an indicating collar (a short PBR 202 or reduced ID collar) followed by a large ID 204 joint is provided as a minimum sump. In cases where there is a long distance between zones an optional indicating collar may be included just below the last large ID liner joint just below the bottommost ZCV within each zone. The indicating collar is used to deactivate the resettable shifting tool as described in the workflow sequences below. By way of example, two embodiments of the workflow are described; the locked-in tension stimulation platform workflow procedure and the weight-down stimulation platform workflow procedure.

The stimulation platform includes a stimulation service string that can be run into hole after the zonal contact platform has been fixed into the borehole. The monitor and control platform can include sensors disposed on the stimulation service string and the zonal contact platform. The monitor and control platform also may include communication lines coupled to sensors and other downhole components.

Figure 46A:
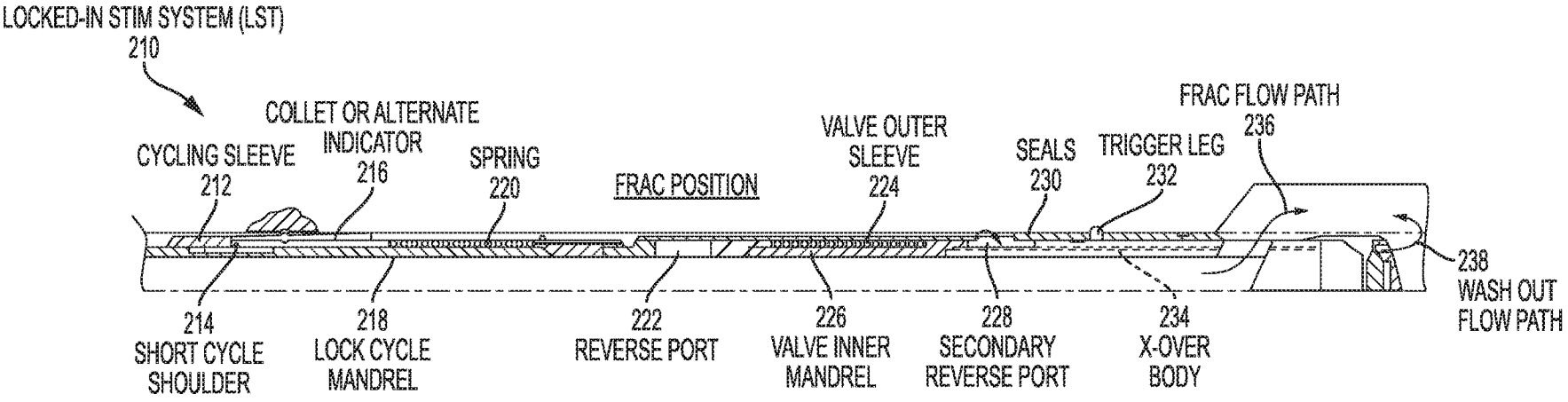
FIG. 46A is a schematic illustration of a locked-in system enabling a locating method which can be used to control a stimulation tip position in a Frac position, according to an embodiment of the disclosure.
Figure 46B:
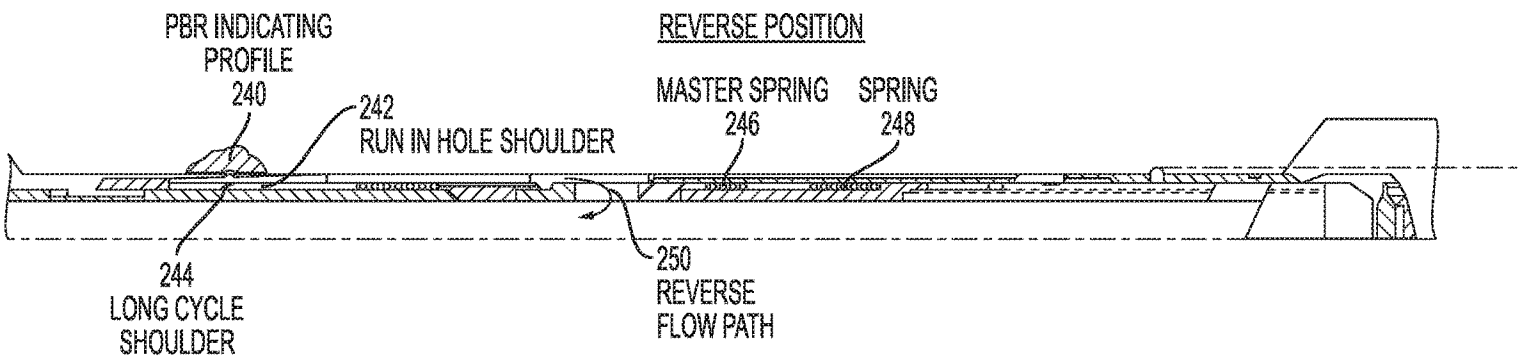
FIG. 46B is a schematic illustration of a locked-in system enabling a locating method which can be used to control a stimulation tip position in a reverse position, according to an embodiment of the disclosure.

A first embodiment of the locked-in stimulation platform workflow procedure is described below. The locked-in stimulation platform includes a Locking Stimulation Tip (LST) 210 (see also FIG. 46) and a Smart Zonal Contact Shifting Tool (SST) 208. The LST 210 work flow procedure may use all or any combination of the following: a cycling sleeve 212, a short cycle shoulder 214, a collet or alternative indicator 216, a spring 220, a lock cycle mandrel 218, a reverse port 222, a valve inner mandrel 226, a valve outer sleeve 224, a secondary reverse port 228, seals 230, trigger lug 232, an x-over body 234 and in the Frac position illustrated in FIG. 46A, frac flow may follow the frac flow path 236 and the washout flow path 238 may flow in the reverse of the frac flow path. FIG. 46B illustrates the Reverse position and reverse flow path 250. FIG. 46B illustrates a PBR indicating profile 240, a run in hole shoulder 242, a long cycle shoulder 244, a washer spring 246, and a spring 248, among other items. The sequence begins as follows once the Stimulation String is RIH and encounters the first PBR.

1. Prior to landing on the PBR take note of the string weight. The BHA is pushed through the PBR. Both the LST and the SST will push through the PBR with weight down. Discrete weight indication patterns will be noted.
2. Mark pipe and note the distance from neutral to slack off activation value (e.g. 15 k pounds)
3. Continue to RIH to engage the SST. The ZCV are closed when the SST passes through the ZCVs at this point.
4. Continue through PBRs and ZCVs down to the large ID parking joint below the bottommost ZCV.
5. Pick up through and open the ZCV in the bottom zone. Each valve opening will be indicated by opening tensile load signature.
6. Pick up the SST through the PBR. This deactivates the SST to the non-active position.
7. POOH—the LST will either pull through or no-go at the bottom of each PBR. Continue to pull the LST into the PBR. If the LST is locked below the PBR (weight indicator shows weight higher than string weight) then slack off to reset the LST. Mark and note the distance to pick up to activation value.
8. On the second attempt to POOH the LST will enter the PBR until it lands inside the indicating profile located inside the PBR (this is indicated by the second indication).
9. At this second indication slack off and pick back up. This sequence locks the LST inside the PBR with the LST in the reverse flow path mode. Also at the same time the SST is reset to activate mode.
10. At this point the flow path down through the PBR is isolated and the communication between upper annulus and tubing is established. Therefore, the work string can be pickled and treating fluids may be spotted.
11. Once the workstring has been cooled down to fracing temperature, the elevator is slacked off to compensate for tubing shrinkage. Mark the tubing for reference.
12. Slack off and pick up to pull the LST up above the PBR.
13. Slack off the LST and land inside the PBR. This is indicated by the second indication; once at the top of the PBR and the second when located inside the PBR.
14. At the second indication, pick up and hold 5-10K pounds above the indicating value to confirm the LST is locked inside the PBR. Because the LST was pushed into the PBR from above, the LST is in the frac flow path mode. Also the position of the locating profile is spaced out such that the LST seals are sealing inside the PBR but the LST frac ports are positioned just below the PBR inside the large ID parking joint.

15. In this tubing condition, close the pipe ram around the work string as a secondary safety barrier.

16. The frac job is pumped according to the designed stimulation program.

17. At screen out the pressure is locked in and held to allow controlled bleed off. The duration of this may vary depending on reservoir properties. However, this hold period should be minimized being mindful of potential proppant falling out of slurry inside the workstring.

18. Once confirming that the tubing and annulus pressures are bled off, the BOP pipe rams are opened and the annular Hydril is closed around the workstring.

19. Reverse circulation is initiated to start washing out the lower section of the LST sticking out below the PBR. In this position the secondary reverse ports are activated and the flow goes down to the tip of the LST and back up the frac ports.

20. Slack off to push the LST below the PBR. Once out of the PBR the reverse path is around the outside of the LST and back up the frac ports. The reverse circulation continues throughout this entire tool manipulation sequence to ensure proppant exposure to outer section of the BHA is minimized.

21. Pick up and locate the LST inside the PBR (indicated by the second indication). Once inside the PBR the LST automatically convert to reverse flow path mode because it was pulled up from the bottom of the PBR.

22. On the second indication, slack off and pick up to lock the LST in the reverse position. Now that the LST is locked in the reverse position higher pump rates can be used to aggressively reverse out the excess proppant inside the work string.

23. Once the work string is clean, push the LST below the PBR to reverse circulate and clean the proppant inside parking joint.

24. Continue to push the SST through the PBR. Going down through the PBR the SST remains in active mode.

25. Continue cleaning and moving down slowly. As the stimulation string moves down through each ZCV the sleeves are closed by the SST as indicated by the load signature. Use caution moving down too fast to minimize the likelihood of exposing the BHA into the debris field.

26. Clean down to the large ID parking joint below the bottommost ZCV.

27. To deactivate the SST, continue reverse clean out and push the SST down past the PBR or Indicating Collar. There will be a number of load signatures to confirm this.

28. In the cases where there is a large distance between zones an indicating collar may be installed below the large ID parking joint located just below the bottommost ZCV. This avoids having to move down the next zone PBR to deactivate the SST.

29. Pick up the BHA up through the PBR or Indicating Collar. This deactivates the SST to the non-active position.

30. With the SST in the non-active position, pick up the BHA to the parking joint just above the top ZCV just treated and closed.

31. Pick up the BHA up above the PBR. This again deactivates the SST.

32. Set down against the LST on top of the PBR to reactivate the SST. In the same motion place the WST (see also FIG. 47) in the frac flow path mode.

33. Pressure up on the zone to confirm the sleeves are closed. If there is a leak then there are three possibilities: ZCV sleeve not closed; WST seals leaking; check valve leaking. The last two will be indicated by communication of pressure to the annulus.

34. Pick up through the next set of ZCVs opening the complete set.

35. Repeat this sequence to treat the subsequent zones above.

Figures 47A, 47B, 47C:
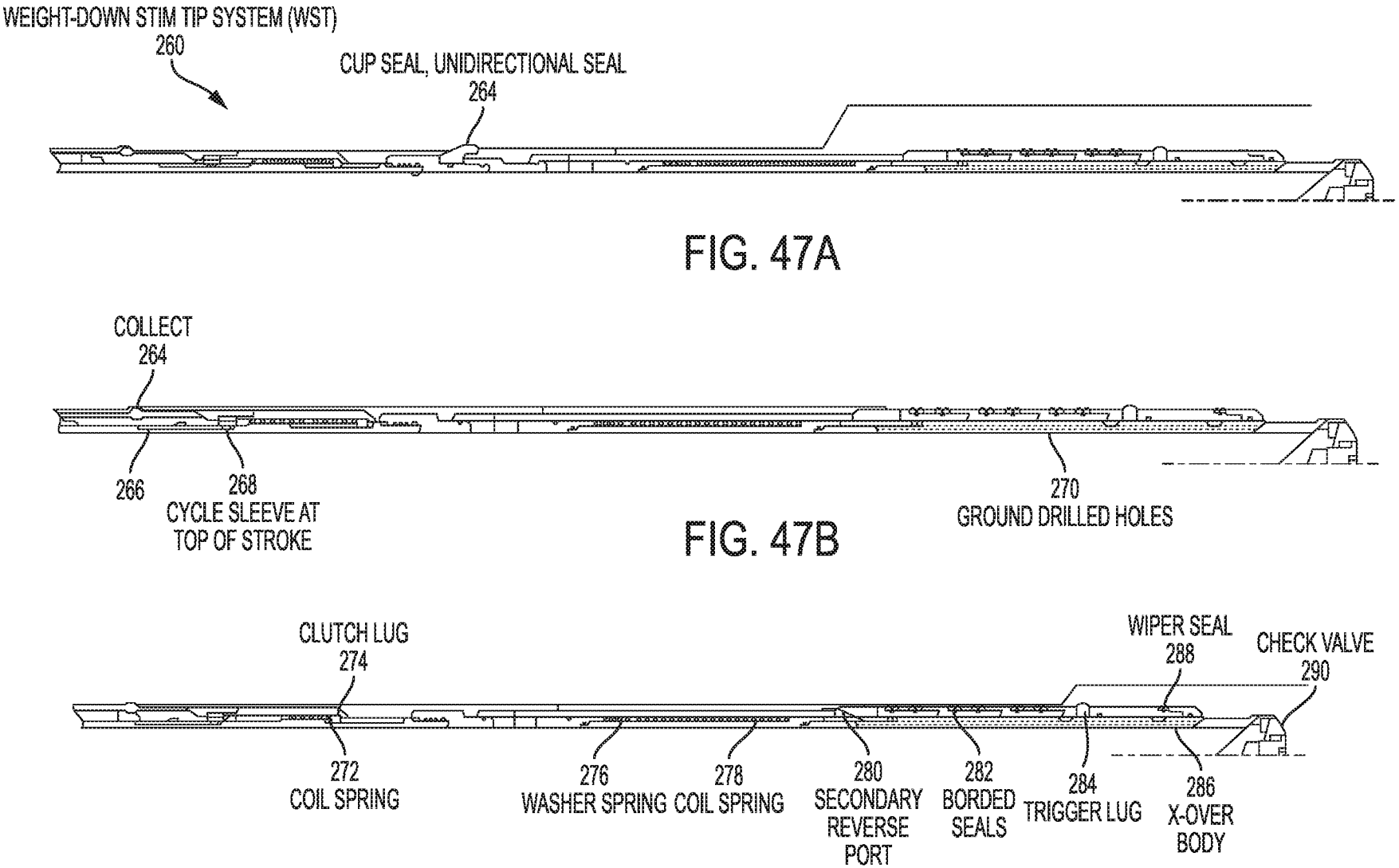
FIG. 47A is a schematic illustration of a weight-down locating system enabling a locating method which can be used to control a stimulation tip position, according to an embodiment of the disclosure.
FIG. 47B is another schematic illustration of the weight-down locating system enabling the locating method which can be used to control a stimulation tip position, according to an embodiment of the disclosure.
FIG. 47C is yet another schematic illustration of the weight-down locating system enabling the locating method which can be used to control a stimulation tip position, according to an embodiment of the disclosure.

An embodiment of the weight-down stimulation platform workflow is similar. The weight-down stimulation platform comprises a Weigh-Down Stimulation Tip (WST) 260 (see also FIG. 47) and a Smart Zonal Contact Shifting Tool (SST). The WST 260 may include the following: a cup seal or unidirectional seal 264, a collet 264, an infinite J-slot 266, a cycle sleeve at top of stroke 268, a clutch lug 274, drilled holes 270, coil spring 272, a washer spring 276, coil spring 278, secondary reverse port 280, bonded seals 282, trigger lug 284, x-over body 286, wiper seal 288, and check valve 290. FIG. 47A illustrates a short stroke and FIG. 47C illustrates a long stroke. The sequence begins once the Stimulation String is RIH and encounters the first PBR.

1. Prior to landing on the PBR take note of the string weight. The BHA is pushed through the PBR. The ZST will always push through the PBR with weight down.

2. However, the WST will either go through or no-go at each PBR. Because there are two shoulders at each PBR (one on top of PBR and one inside the PBR locating profile) the WST will no-go at every PBR going down. No-go is indicated by loads greater than string weight plus a set activation load limit.

3. Mark pipe and note the distance from neutral to slack off activation value (e.g. 15 k pounds)

4. Continue to RIH to engage the SST and close the ZCV (each ZCV should be closed at this point)

5. Continue through PBRs and ZCVs down to the large ID parking joint below the bottommost ZCV.

6. Pick up and open the ZCV which are in the bottom zone. Each valve opening will be indicated by opening tensile load signature.

7. Pick up the SST through the PBR. This deactivates the SST to the non-active position.

8. Continue to pull the WST into the PBR. At the bottom of the PBR the WST will give an indication but above the set activation load value the WST will enter the PBR until it lands inside the indicating profile located inside the PBR (this location is indicated by two successive indications).

9. At the second indication continue to pick up above the activation load value to pull out of the PBR (a fixed distance).

10. Once the indicating collet is above the PBR, slack off on the top of the PBR down past the set activation value. If the slack of weight is greater than activation value then continue to set down the anticipated compensating weight down load. If unable to go above the activation load value pick back up above the PBR and on the second attempt at set down, the WST will no-go on top of the PBR. The WST is now in the reverse flow path mode. Also in the same sequence the SST is recocked to activate mode.

11. At this point the flow path down through the PBR is isolated and the communication between upper annulus and tubing is established. Therefore, the work string can be pickled and treating fluids may be spotted.

12. Once the work string has been cooled down to fracing temperature, the elevator is adjusted to compensate for tubing shrinkage. Mark the tubing for reference.

13. Pick up to pull the WST up above the PBR. This is indicated by full pick up weight.

14. Slack off the WST and land inside the PBR. This is indicated by the second indication; once at the top of the PBR and the second when located inside the PBR.

15. At the second indication, slack off and hold down the anticipated sand out spike load plus a suitable safety margin. Note the push through the top of the PBR recocked the WST into the set down mode on the next locating profile inside the PBR. This set down load holds the WST inside the PBR. Because the WST was pushed into the PBR from above, the WST is in the frac flow path mode. Also the position of the locating profile is spaced out such that the WST seals are sealing inside the PBR but the WST frac ports and the WST trigger buttons are positioned just below the PBR inside the large ID parking joint.

16. One methodology for working out this space out is to use a cup seal landed inside the PBR and the WST seals spaced out inside the large ID parking joint (see FIG. 47). If the cup seal pressure rating is not viable the fall back design is to use the bonded seal and space out accordingly.

17. In this tubing condition, close the pipe ram around the work string as a secondary safety barrier.

18. The frac job is pumped according to the designed stimulation program.

19. At screen out, the pressure is locked in and held to allow controlled bleed off. The duration of this may varies depending on reservoir properties. However, this hold period should be minimized being mindful of potential proppant falling out of slurry inside the workstring.

20. Once confirming that the tubing and annulus pressures are bled off, the BOP pipe rams are opened and the annular Hydril is closed around the work string.

21. Initiate reverse circulation to start washing out the lower section of the WST sticking out below the PBR. In this position the secondary reverse ports are activated (if WST seals are inside the PBR) and the flow goes down to the tip of the WST and back up the frac ports. In the cup seal case, the reverse flow goes past the cup seal and back up the frac ports.

22. With the WST design, pick straight pull up into the reverse flow path mode. Because the WST trigger button was below the PBR at the beginning of the Frac job, straight pull up automatically converts the WST into the reverse flow path mode. Pick up out of the indicating profile (a fixed distance) then set down against the top of the PBR to recock the cycle sleeve.

23. Pick up and set down again on top of the PBR a second time to no-go weight down position. The reverse circulation continues throughout this entire tool manipulation sequence to ensure proppant exposure to outer section of the BHA is minimized.

24. Now that the WST is locked down in the reverse position higher pump rates can be used to aggressively reverse out the excess proppant inside the work string.

25. Once the work string is clean, pick up and then push the WST below the PBR to reverse circulate and clean the proppant inside parking joint. Note the WST will automatically no-go inside the PBR locating profile because the cycle is automatic.

26. Continue to push the SST through the PBR. Going down through the PBR the SST remains in active mode.

27. Continue cleaning and moving down slowly. As the stimulation string moves down each ZCV sleeve is closed by the SST as indicated by the load signature. Use caution with respect to moving down too fast to minimize the likelihood of exposing the BHA into the debris field.

28. Clean down to the large ID parking joint below the bottommost ZCV.

29. To deactivate the SST, continue cleaning and push the SST down past the PBR or Indicating Collar. There will be number of indications to confirm this.

30. In the cases where there is a large distance between zones an indicating collar is located below the large ID parking joint just below the bottom most ZCV. This avoids having to move down to the next zone PBR to deactivate the SST.

31. Pick up the BHA up through the PBR or Indicating Collar. This deactivates the SST to the non-active position.

32. With the SST in the non-active position, pick up the BHA to the parking joint just above the top ZCV just treated and closed.

33. Pick up the BHA up above the PBR. This again deactivates the SST.

34. Set down against the WST on top of the PBR to reactivate the SST. In the same motion place the WST in the frac flow path mode.

35. Pressure up on the zone to confirm the sleeves are closed. If there is a leak then there are three possibilities: ZCV sleeve not closed; WST seals leaking; check valve leaking. The last two will be indicated by communication of pressure to the annulus.

36. Pick up through the next set of ZCVs opening the full set.

37. Repeat this sequence to treat the subsequent zones above.

It should be noted the sequences described above have been provided as examples and should not be construed as limiting. For example, portions of the sequences may be added, removed, and/or adjusted to accommodate the parameters of a given application. Additionally, the components and assemblies utilized in carrying out a given sequence may change or be adjusted. Consequently, the sequence may be changed to accommodate characteristics of the equipment employed. In another embodiment, for example, a successive stroke of a service tool through the zonal fracture and flow system may be used to form a no-go and then to remove the no-go in a manner which accomplishes the same type of weight down mechanism. By placing this type of feature on the service tool, the feature/tool is more readily pulled out for repair or replacement.

Figure 48A:
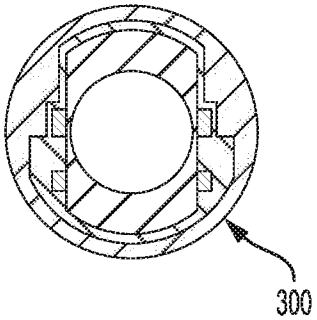
FIG. 48A is a cross-sectional view of the schematic illustration of FIG. 48 taken along line IILA-IILA, according to an embodiment of the disclosure.
Figure 48:
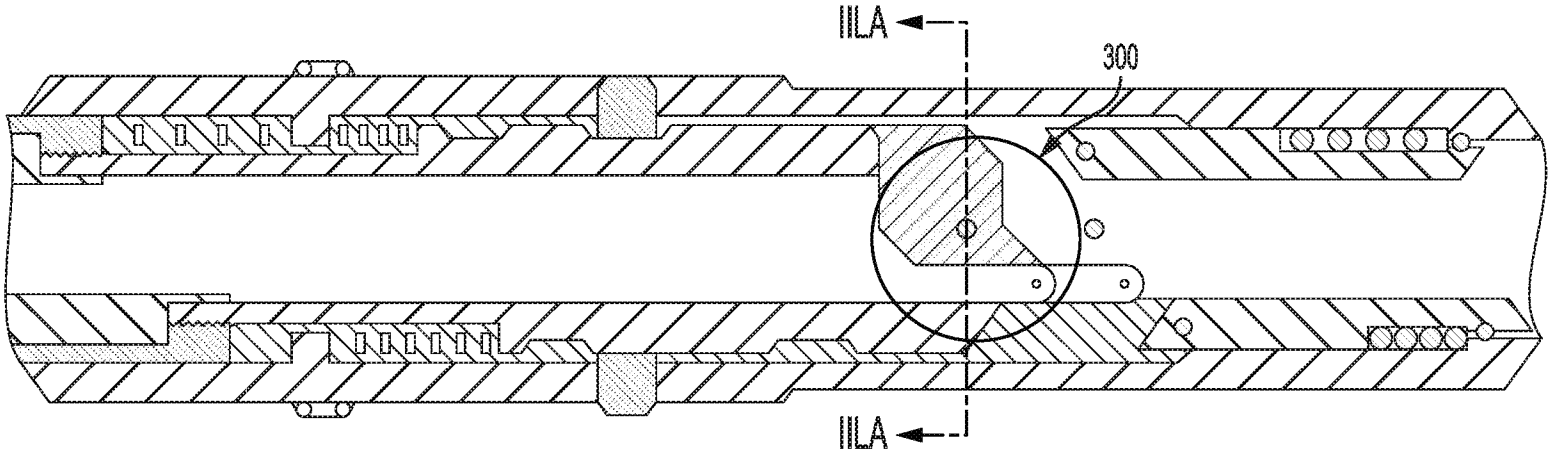
FIG. 48 is a schematic illustration of another embodiment of a frac tip valve assembly, according to an embodiment of the disclosure.
Figure 49:
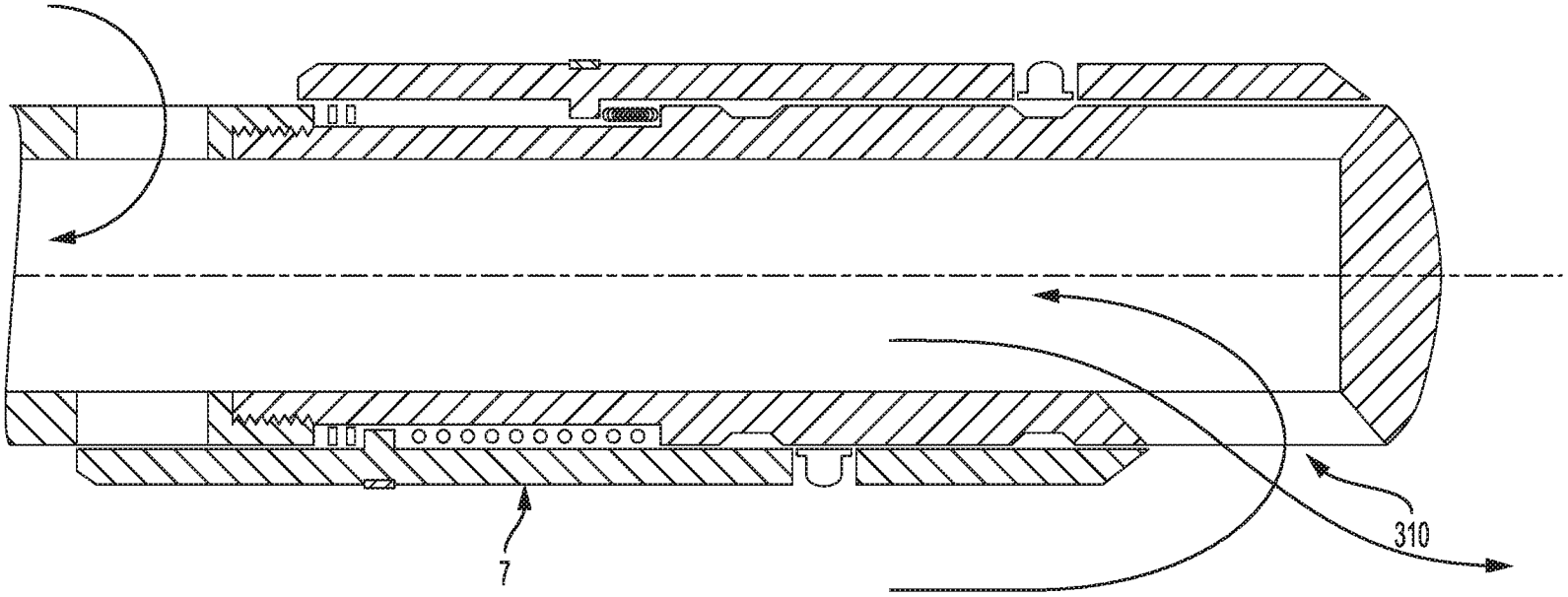
FIG. 49 is a schematic illustration of another embodiment of a valve frac tip assembly, according to an embodiment of the disclosure.

The various assemblies and components may be modified according to the parameters of a given application. As illustrated in FIGS. 48-53, other types of assemblies may be added or substituted with respect to embodiments described above. For example, the zonal fracture and flow system may utilize a ball type valve frac tip assembly 300, as illustrated in FIG. 48 and FIG. 48A as taken along cross section IIVA, to selectively open and close the inside diameter. In FIG. 49, another embodiment is illustrated in the form of a sleeve type valve frac tip assembly 310 which similarly may be used to selectively open and close the inside diameter.

Figure 50A:
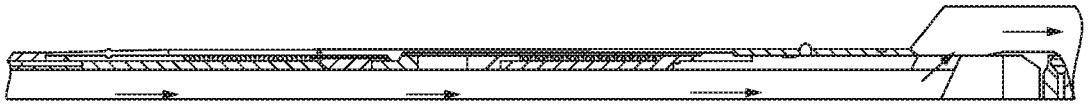
FIG. 50A is a schematic illustration of an operational example of the valve frac tip assembly in a pick up to reverse position, according to an embodiment of the disclosure.
Figure 50B:
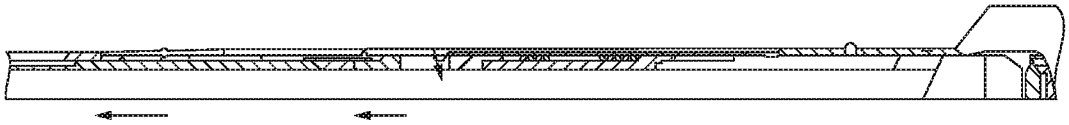
FIG. 50B is another schematic illustration of the operational example of the valve frac tip assembly in a pick up to reverse position, according to an embodiment of the disclosure.
Figure 51:
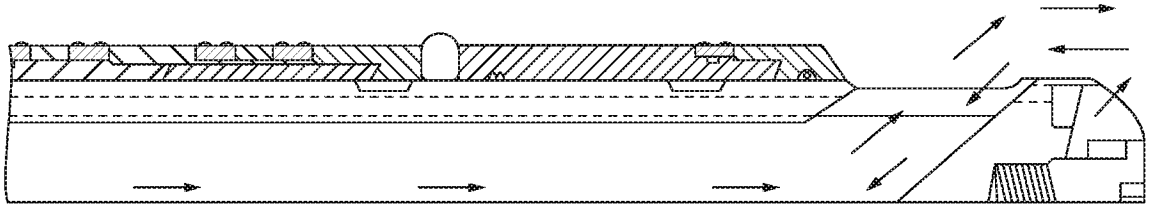
FIG. 51 is a schematic illustration of an operational example of the valve frac tip assembly in a secondary, clean-out reverse position, according to an embodiment of the disclosure.
Figure 52A:
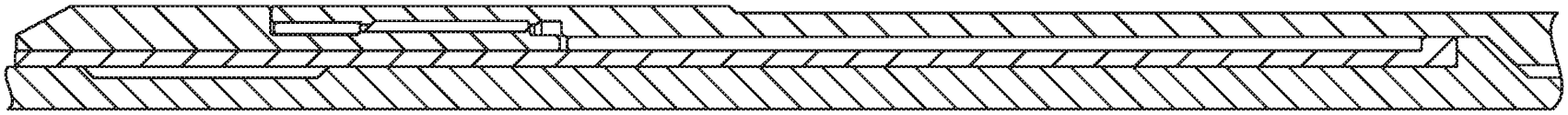
FIG. 52A is a schematic illustration of an embodiment of a smart shifting tool also known as a resettable shifting tool, according to an embodiment of the disclosure.
Figure 52B:
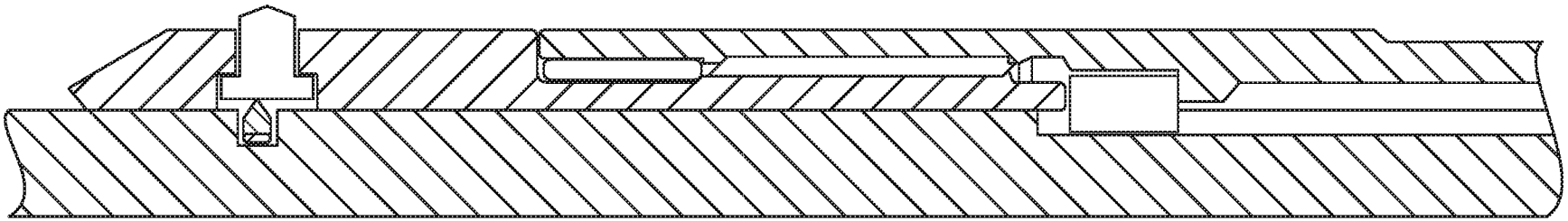
FIG. 52B is another schematic illustration of the embodiment of the smart shifting tool also known as the resettable shifting tool, according to an embodiment of the disclosure.
Figure 53:
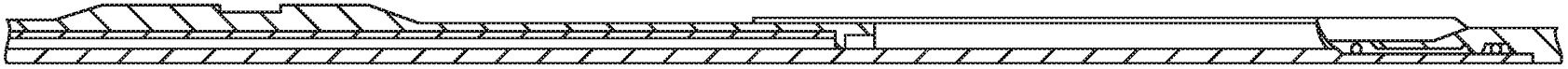
FIG. 53 is another schematic illustration of the embodiment of the smart shifting tool also known as the resettable shifting tool, according to an embodiment of the disclosure.

Actuation of the various valve frac tip assemblies also may be achieved via various techniques. For example, FIG. 50 illustrates a pick up movement to transition the frac tip assembly from a frac position (above) to a reverse position (below). A suitable pick up or slack off also may be used to shift the valve frac tip assembly to a secondary clean-out reverse position, as illustrated in FIG. 51. Depending on the parameters of a given application, a wide variety of tools may be utilized to enable tool shifting or other types of tool transition. For example, an embodiment of a smart shifting tool is illustrated in FIG. 52 and may be utilized in facilitating desired tool shifting actions.

Depending on the parameters of a given application, the zonal fracture and flow system may utilize a variety of other and/or additional components and assemblies. Furthermore, those components and assemblies may be operated in various sequences to achieve the desired results. Although the system has been described as comprising a zonal frac and flow valve, a tip valve assembly 110, a tip locating assembly 112, and a resettable shifting assembly 112, some applications may utilize a subset of these assemblies. Additionally, each of the assemblies may be adjusted with different components and/or different configurations to accommodate the parameters of a given application.

Although a few embodiments of the disclosure have been described in detail above, those of ordinary skill in the art will readily appreciate that many modifications are possible without materially departing from the teachings of this disclosure. Accordingly, such modifications are intended to be included within the scope of this disclosure as defined in the claims.

What is claimed is:

1. A system for efficiently frac packing a tight reservoir formation, comprising:

a zonal fracture and flow system comprising:

a zonal frac and flow valve;

a polished bore receptacle;

a first casing joint located between the zonal frac and flow valve and the polished bore receptacle;

a tip valve assembly;

a tip locating assembly, wherein the tip valve assembly and the tip locating assembly are disposed within the polished bore receptacle;

a second casing joint positioned above the polished bore receptacle; and a resettable shifting assembly, wherein the resettable shifting assembly is disposed within the second casing joint, wherein the zonal frac and flow valve comprises a combined screen and sleeve, the combined screen and sleeve comprising a screen carried on an outer surface of a sleeve, wherein the combined screen and sleeve serves as a valve through which fracturing fluid flows outwardly during a stimulation procedure, wherein, during a production procedure, production fluid flows from the formation, through the screen and across the outer surface of the sleeve of the combined screen and sleeve, and upward through the zonal frac and flow valve, wherein the tip valve assembly controls a change in flow path from a frac port to a reverse port by manipulating a tip valve closing sleeve, wherein the tip locating assembly controls a position of a stimulation tip by using weight indications to track the position of the stimulation tip, wherein the tip locating assembly allows for a weight down mode to maintain the position and configuration of the tip valve assembly with respect to frac and reverse positions, wherein the resettable shifting assembly is configured to shift sleeves having a mating profile.

2. The system as recited in claim 1, wherein the resettable shifting tool comprises a shifting collet which works in cooperation with an inner mandrel.

3. The system as recited in claim 1, wherein when the combined screen and sleeve is in an open position, the zonal frac and flow valve becomes a zonal contact valve.

4. The system as recited in claim 2, wherein the resettable shifting tool comprises an active mode in which the shifting collet is locked to the inner mandrel such that when the shifting collet grabs the mating profile of the corresponding sleeve, the shifting collet is able to shift the corresponding sleeve and then release from the corresponding sleeve.

5. The system as recited in claim 4, wherein the resettable shifting tool comprises a de-active mode in which the shifting collet is unlocked from the inner mandrel such that when the shifting collet grabs the mating profile of the corresponding sleeve, the shifting collet collapses and releases from the corresponding sleeve.

6. The system as recited in claim 1, wherein the zone frac and flow valve further comprises an electric valve.

7. The system as recited in claim 1, wherein the zonal fracture and flow system is modular.

8. A method, comprising:

combining a zonal frac and flow valve, a polished bore receptacle, a first casing joint, a tip valve assembly, a tip locating assembly, a second casing joint, and a resettable shifting assembly into a zonal frac and flow system, wherein the first casing joint is located between the zonal frac and flow valve and the polished bore receptacle, wherein the tip valve assembly and the tip locating assembly are disposed within the polished bore receptacle, wherein the second casing joint is positioned above the polished bore receptacle, wherein the resettable shifting assembly is disposed within the second casing joint; and operating the zonal frac and flow system to sequentially operate in a spot fluid mode, stimulate fracture mode, clean-out reverse mode, and reverse circulate mode, wherein the zonal frac and flow valve comprises a combined screen and sleeve, the combined screen and sleeve comprising a screen carried on an outer surface of a sleeve, wherein operating comprises delivering fracturing fluid outwardly via controlling the combined screen and sleeve, the method further comprising:

initiating a production procedure during which production fluid flows from a formation, through the screen and across the outer surface of the sleeve of the combined screen and sleeve, and upward through the zonal frac and flow valve, wherein operating further comprises using the tip valve assembly to control a change in flow path from a frac port to a reverse port by manipulating a tip valve closing sleeve, wherein operating further comprises using the tip locating assembly to control a position of a stimulation tip by using weight indications to track the position of the stimulation tip, wherein operating further comprises using the tip locating assembly to allow for a weight down mode to maintain the position and configuration of the tip valve assembly with respect to frac and reverse positions, and wherein operating further comprises using the resettable shifting tool to shift sleeves having a mating profile.

9. The method as recited in claim 8, wherein the fracturing fluid is delivered when the combined screen and valve is in an open position.

10. The method as recited in claim 8, wherein the combined screen and valve is in a closed position during the production procedure.

* * * * *